US010290174B2

(12) United States Patent
Rehill et al.

(10) Patent No.: US 10,290,174 B2
(45) Date of Patent: May 14, 2019

(54) SYSTEMS AND METHODS FOR MODIFYING A GAME INTERFACE OF AN ONLINE GAME

(71) Applicant: Gamesys Ltd., London (GB)

(72) Inventors: Jagbir Rehill, Middlesex (GB); Hans Elias, Hertfordshire (GB); Thomas David James Aicken, London (GB)

(73) Assignee: Gamesys, Ltd., London (GB)

( * ) Notice: Subject to any disclaimer, the term of this patent is extended or adjusted under 35 U.S.C. 154(b) by 0 days.

(21) Appl. No.: 14/937,873

(22) Filed: Nov. 11, 2015

(65) Prior Publication Data

US 2016/0063798 A1 Mar. 3, 2016

Related U.S. Application Data

(63) Continuation of application No. PCT/US2015/029559, filed on May 6, 2015.

(60) Provisional application No. 61/989,512, filed on May 6, 2014.

(51) Int. Cl.

| | |
|---|---|
| ***G07F 17/32*** | (2006.01) |
| ***A63F 1/04*** | (2006.01) |
| *A63F 3/00* | (2006.01) |

(52) U.S. Cl.

CPC ..... *G07F 17/3204* (2013.01); *A63F 1/04* (2013.01); *G07F 17/3293* (2013.01); *A63F 2003/00996* (2013.01)

(58) Field of Classification Search

CPC ..... G07F 17/3204; G07F 17/3293

USPC ..... 463/22

See application file for complete search history.

(56) References Cited

U.S. PATENT DOCUMENTS 5,489,101 A * 2/1996 Moody ..... A63F 3/00157 273/292
7,503,846 B2 * 3/2009 Owen ..... G07F 17/32 273/138.1
7,614,946 B2 * 11/2009 Nicely ..... G07F 17/32 273/274

(Continued)

OTHER PUBLICATIONS

Written Opinion for PCT/US15/029559 dated Aug. 12, 2015; 8 pps.

(Continued)

*Primary Examiner* — Omkar A Deodhar
*Assistant Examiner* — Shauna-Kay Hall
(74) *Attorney, Agent, or Firm* — Fincham Downs LLC; Magdalena M. Fincham

(57) ABSTRACT

In accordance with some embodiments, a system for facilitating a card game provide for outputting a game interface which includes a plurality of card positions into which cards are placed, the card positions being configured in a triangle configuration, wherein the plurality of card positions include at least one subset of card positions within the triangle configuration, each of the at least one subset arranged in a respective sub-triangle located within the triangle configuration into which the plurality of card positions are arranged. A plurality of cards are dealt for a game event and placed into the card positions. If the plurality of dealt cards includes a first winning combination of cards, a prize is awarded to the player. In some embodiments, a prize is also awarded for any sub-combination of cards in a subset of card positions that qualifies as a winning card combination.

18 Claims, 8 Drawing Sheets

(56) References Cited

U.S. PATENT DOCUMENTS

| | | | | |
|---|---|---|---|---|
| 7,785,182 | B2 * | 8/2010 | Thomas | G07F 17/32 273/292 |
| 8,100,752 | B2 * | 1/2012 | Watkins | G07F 17/32 463/2 |
| 2003/0162424 | A1 * | 8/2003 | Berman | A63F 3/00157 439/131 |
| 2004/0033824 | A1 * | 2/2004 | Fitzhugh | G07F 17/34 463/13 |
| 2013/0049298 | A1 * | 2/2013 | Andrews | A63F 3/0052 273/267 |

OTHER PUBLICATIONS

International Search Report for PCT/US15/029559 dated Aug. 12, 2015; 2 pps.
International Preliminary Report on Patentability for PCT/US15/029559 dated Nov. 17, 2016; 6 pps.

* cited by examiner

SYSTEMS AND METHODS FOR MODIFYING A GAME INTERFACE OF AN ONLINE GAME

CLAIM OF PRIORITY

This application is a Continuation Application of PCT Application No. PCT/US15/029559 filed on May 6, 2015 in the name of Rehill et al., titled SYSTEMS AND METHODS FOR FACILITATING A CARD GAME; this PCT Application claims the benefit of U.S. Provisional Application No. 61/989,512 filed on May 6, 2014 in the name of Rehill et al., titled SYSTEMS AND METHODS FOR FACILITATING A CARD GAME. The entirety of each of these Applications is incorporated by reference herein for all purposes.

DETAILED DESCRIPTION OF EXAMPLE EMBODIMENTS

I. Introduction

Figure 1:
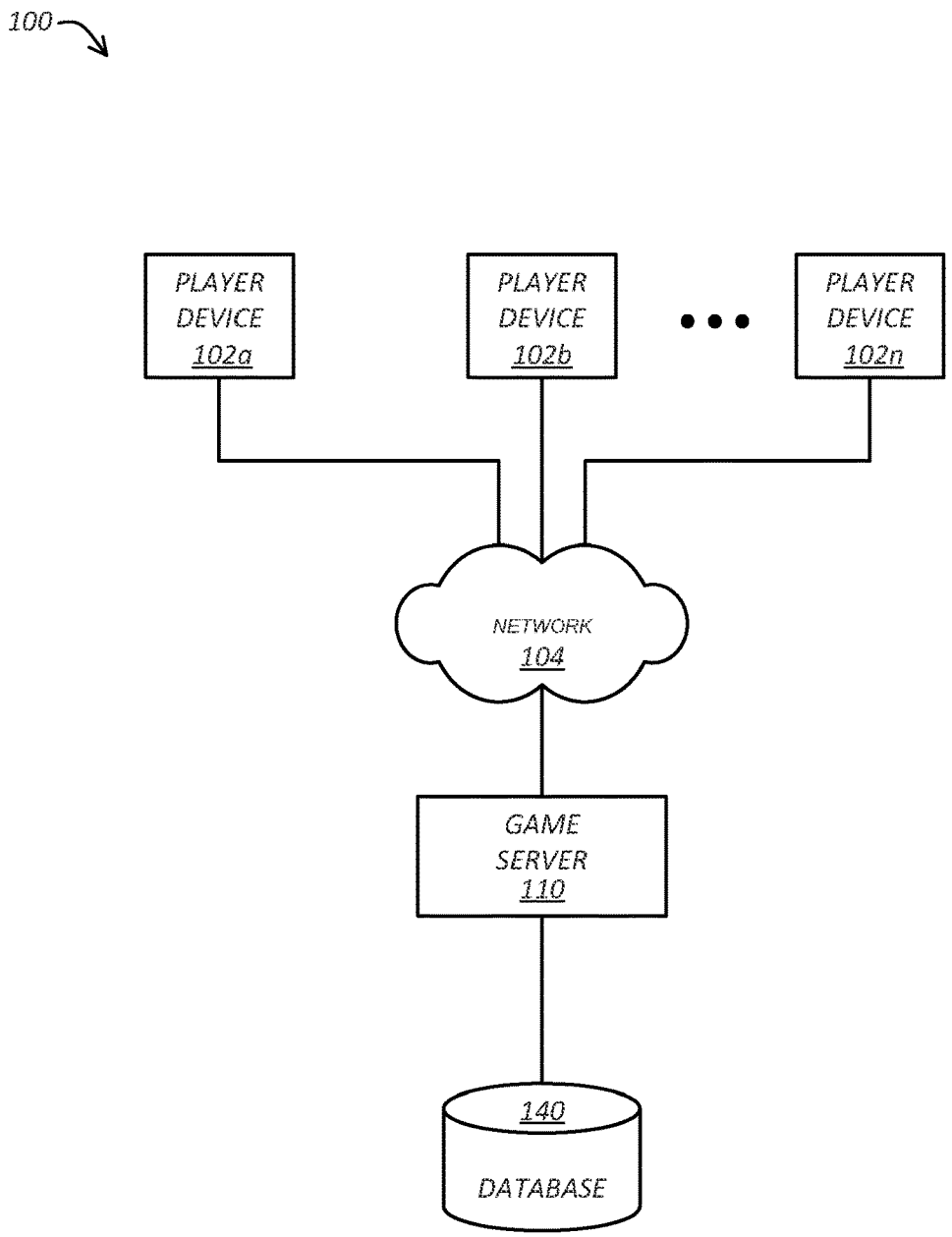
FIG. 1 is a schematic diagram of an embodiment of a gaming system in accordance with one or more embodiments described herein.

Applicants have recognized that there is a need for new and exciting types of card games, particularly ones which allow for side bet opportunities. Applicants have further recognized that there is a need for new and exciting types of card games which provide for interesting player decisions, such as whether to replace one or more cards in a card game in which at least one card is located within more than one combination of cards such that replacing the at least one card may cause a first combination of cards to increase in value (e.g., qualify for a prize when it had not qualified for a prize before the replacing or qualify for a more valuable prize than it had prior to the replacing) while simultaneously causing a second combination of cards to decrease in value (e.g., no longer qualify for a prize when it had qualified for a prize before the replacing or qualify for a less valuable prize than it had prior to the replacing).

In accordance with some embodiments, systems, methods and articles of manufacture (e.g., non-transitory computer-readable media) provide for facilitating a card game by provide a game interface which includes a plurality of card positions into which cards are placed, the card positions being arranged in an area of a first geometric shape (e.g., a triangle), wherein the plurality of card positions include at least one subset of card positions arranged in a respective sub-area of the area, each such sub-area forming a respective second geometric shape within the first geometric shape (e.g., a smaller triangle within a triangle comprising the first geometric shape). When a plurality of cards is dealt for a game event, a single card of the dealt plurality of cards may be placed into each card position. It may then be determined (e.g., after a player places at least one wager on the game event) whether the plurality of dealt cards placed into the card positions arranged in the area forming the first geometric shape qualifies for a first prize and, if the plurality of cards does, a first prize corresponding to the first winning combination of cards may be provided to the player.

In accordance with some embodiments, facilitating the card game may further comprise determining that cards placed into a particular subset of the at least one subset of card positions arranged in a particular sub-area of the area forming the second geometric shape qualify for a second prize because a value of at least one first card of the cards placed into the particular subset, which at least one first card is positioned in a first positional relationship relative to at least one second card of the particular subset of cards, satisfies a predetermined mathematical relationship with respect to a value of the at least one second card of the particular subset of cards and causing the second prize to be provided to the player. For example, if the subset of cards consists of three cards arranged in a triangle shape such that two of the cards are positioned in a bottom row and the third card is positioned in a top row, this may comprise determining that a sum of the value of the two cards in the bottom row equals the value of the card in the top row. In accordance to some embodiments, determining that the plurality of dealt cards qualify for a first prize comprises determining that a first value of at least one first card of the plurality of cards, which at least one first card is positioned in a first predetermined positional relationship relative to at least one second card of the plurality of cards, satisfies a predetermined mathematical relationship with respect to a value of the at least one second card. In some embodiments, determining that the plurality of dealt cards qualify for a first prize comprises determining that the plurality of dealt cards share a common characteristic (e.g., are all of the same color and/or suit). In some embodiments, determining that the plurality of cards qualify for a first prize comprises determining that the plurality of cards falls within a category of a winning combination of cards (e.g., a straight or a flush).

In accordance with some embodiments, all of the dealt cards comprise a first combination of cards and a set of cards within the at least one subset of card positions form a respective second combination of cards. In accordance with some embodiments, at least one card of the dealt plurality of cards is placed such that it is within more than one combination of cards. This may be, for example, because the at least one card is within both the first geometric shape and the second geometric shape and the second geometric shape is within the first geometric shape. In another example, this may be because two or more of the respective second geometric shapes overlap by at least one common card position. In accordance with some embodiments, a player is provided an opportunity to replace at least one card of the dealt plurality of cards prior to a result being determined for the game event (e.g., the player may select to have the card which is within the more than one combination of cards replaced with a different card (e.g., a newly dealt card that was not one of the cards within the dealt plurality of cards)).

In accordance with some embodiments, systems, methods and articles of manufacture (e.g., non-transitory computer-readable media) provide for facilitating a card game by providing a game interface which includes a plurality of card positions into which cards are placed, the card positions being configured in a triangle configuration, wherein the plurality of card positions include at least one subset of card positions within the triangle configuration, the at least one subset arranged in a sub-triangle located within the triangle configuration into which the plurality of card positions are arranged. For example, the card positions may be arranged in a six-card triangle configuration, with three card positions being arranged in a bottom row, two card positions being arranged in a middle row and one card position being arranged in a top row. A plurality of cards may be dealt for a game event and a single card of the plurality of dealt cards may be placed into each card position of the plurality of card positions. Upon receiving from the player an indication of at least one wager for the game event, it may be determined whether the plurality of dealt cards includes a first winning combination of cards and, if it is determined that the plurality of dealt cards does include a first winning combination of cards, a first prize corresponding to the first winning combination of cards may be provided to the player.

In accordance with some embodiments, additional prizes may be won by a player if sub-combinations of cards within the plurality of dealt cards also include winning card combinations. For example, an additional prize may be won by a player if the cards in a subset of card positions arranged in a sub-triangle located within the triangle configuration also include a winning card combination. In some embodiments, the plurality of card positions may include a plurality (e.g., three) of subsets of card positions which may each qualify for a separate prize if the cards placed there into include a winning card combination. In some embodiments, a player may place a separate wager (or distribute portions of his wager) on each such available subset of card positions.

In accordance with some embodiments, a player may be allowed an opportunity to discard and replace at least one card of the plurality of dealt cards. Such a feature may provide for interesting decisions within the game, since in some circumstances a player may face a choice of potentially giving up a prize (e.g., for a first sub-combination of cards in a first subset of card positions which include a winning card combination based on the initially dealt cards) in order to attempt and win a larger prize (e.g., the player may hope that a replacement card will qualify the player for a larger prize associated with a second sub-combination of cards or for all of the plurality of cards dealt for the game event). An example of such a circumstance is provided herein with respect to FIGS. 4A-4D.

The embodiments described herein may be applied to many different card games and are not limited to electronic card games. For example, at least some embodiments may be utilized in card game using real cards (e.g., a game playable on a card table in a casino). Other embodiments may be utilized in online card games (e.g., accessible via a web browser), software applications (e.g., downloadable game software for playing the card game) or in games embodied as software stored on tangible storage media such as a CD-ROM or a handheld game device.

Many popular versions of card games, including poker games, are played with one or more decks, each deck consisting of 52 cards, with winners are determined based on player hands including a plurality of cards (e.g., five card hands in a typical poker hand, two or more cards in a blackjack game, etc.). In some types of card games, whether a player hand is a winning hand is determined by comparing the player hand to a dealer hand (e.g., as in a blackjack game). In other types of card games, whether a player hand is a winning hand is determined by comparing the composition of the hand (i.e., the cards comprising the player hand) to a predetermined table or set of card combinations which are considered winning hands because they correspond to a payout or other prize. If the player hand matches or falls within a category defining a winning hand, the player hand may be determined to be a winning hand. For example, in a typical poker game, hands or combinations of cards are typically linearly ordered in terms of "rank." For many games, there are nine general categories of hands, ranked as shown in Table 2. However, the embodiments described herein are not limited to poker-type card games or poker-type card games in which winning hands are limited to the nine categories of hands illustrated in Table 2. For example, in a blackjack-type card game the determination of whether a player's hand is a winning hand may be based on whether the value of the hand beats the value of a dealer's hand (or, in one embodiment, another player's hand) without exceeding the value of 21. In another embodiment, a determination of a winning hand may include determining whether the hand includes hi-low cards, all even, all odd, etc. A game provider may choose to define a winning hand in any manner desirable and the embodiments described herein are not limited to any particular types of winning hands or winning hand determinations or types of bets.

TABLE 1

Poker Hand Rankings

| Rank | Name | Explanation | Example |
|---|---|---|---|
| 1 | Royal Flush | A straight from a ten to an ace with all five cards of the same suit. | $A^H K^H Q^H J^H 10^H$ |
| 2 | Straight Flush | Any straight with all five cards of the same suit. | $J^D 10^D 9^D 8^D 7^D$ |
| 3 | Four of a Kind | Any four cards of the same rank. | $K^S K^D K^H K^C 9$ |
| 4 | Full House | Any three cards of the same rank together with any two cards of the same rank. | $J^D J^H J^S 3^H 3^D$ |
| 5 | Flush | Any five cards of the same suit (not consecutive). | $A^H 10^H 9^H 5^H 2^H$ |
| 6 | Straight | Any 5 consecutive cards of different suits. | $6^H 5^D 4^C 3^H 2^D$ |
| 7 | Three of a Kind | Any three cards of the same rank. | $A^S A^H A^D K^C Q^D$ |
| 8 | Two Pair | Any two cards of the same rank together with another two cards of the same rank. | $A^H A^S K^H K^D Q^S$ |
| 9 | One Pair | Any two cards of the same rank. | $A^H A^S K^C Q^S J^D$ |
| 10 | High Card | Any hand not in the above-mentioned hands. | $A^H K^S Q^D J^C 9^S$ |

In typical card games, within each category, hands are ranked according to the rank of individual cards, with an ace being the highest card and a 2 being the lowest card all four suits are valued equally. If a round or hand of a game ends with a player having a set of cards which comprise one of the categories ranked above (e.g., Flush, Straight or Full House) the player may win a corresponding payout. Thus, during play of the game the player is attempting to obtain cards which will make up one of the ranked categories of hands which correspond to a payout (e.g., the player may take additional cards from the deck, turn in cards, etc., based on the rules of the game being played). Thus, during play of a typical card game a player may be required to make decisions during play based on the composition of his hand (i.e., the cards making up his hand) at the time of the decision, with the goal of ending the round or hand with the highest ranked set of cards possible.

Applicants have recognized that players who enjoy playing card games would appreciate a new type of card game with new betting opportunities which still allow for some player decisions and strategy during play. Such a game is described herein and may be, for example, a game playable online via a website or virtual casino establishment.

In one embodiment, a player is dealt a plurality of cards (e.g., after the cards are shuffled or otherwise randomized) which are placed into an area forming a particular configuration or geometric shape, such as a triangle. The number of cards dealt may be a subset of the total number of cards available for dealing (e.g., a subset of the number of cards in the at least one deck from which cards are being dealt). In one embodiment, there are X number of cards dealt, wherein X is six (6). Of course, X may be another predetermined number. In one embodiment, the X number of cards initially dealt to a player are initially dealt face down (such that the player to whom the cards are dealt cannot see a value of the cards, such as the suit, color, number value or other characteristic of the individual cards which distinguishes them from one another). As described, the X number of cards dealt may be output in a particular pattern or configuration, such as a pyramid or triangle (as illustrated below). For example, if there are six (6) total cards dealt to the player, three (3) cards may be arranged in a first (e.g., bottom) row, two (2) cards may be arranged in a second (e.g., middle) row and one (1) card may be arranged in a third (top) row. A triangle or pyramid form may thus be output via the cards. Of course other configurations may be utilized, such as an inverted pyramid or inverted triangle or a square. Further, the embodiments described herein are not reliant on any particular number of cards being dealt to the player (whether in a given row or otherwise).

In accordance with some embodiments, prior to the respective values of dealt cards being revealed to the player (e.g., prior to the dealt cards being turned face up), the player may be provided with an opportunity to place at least one wager based on the dealt cards. In some embodiments, a value of at least one dealt card may be revealed to the player prior to a player finalizing his wager for the game event. In some embodiments, a player may be allowed to place wagers once all of the cards to be dealt face down are dealt. In other embodiments, a player may (alternatively or additionally) be provided with an opportunity to place (or modify) one or more wagers contemporaneously with the cards being dealt or even before any cards are dealt (e.g., such as in some reeled slot machine games, wherein a player places a wager and actuates a "spin" mechanism in order to initiate a determination of the outcome (or determination game elements comprising the outcome)).

In one embodiment, the player may be provided with numerous wager options via an interface of the online game. In a particular example, a menu of possible wagers may be provided to the player, each wager corresponding to a possible winning combination of cards, and the player may be allowed to select which of the possible winning combination(s) the player thinks will be part of the final outcome (once the cards are turned face up), thus placing a wager only on the desired winning combinations. In another embodiment, the player may place a wager on the outcome of the game without selecting which particular winning combination(s) of cards the outcome may comprise. For example, similar to how a wager in a reeled slot machine type of game or a video poker game is placed, a player selects a magnitude of a wager which corresponds to a payout table which comprises a plurality of possible winning outcomes (e.g., card combinations) and a respective payout corresponding to each possible winning outcome. If, upon resolution of the game, the dealt cards include one or more of the winning outcomes, the player is provided the payout(s) which correspond to such winning outcomes. Examples of possible winning outcomes which may correspond to payouts in one or more embodiments of the card game described herein are described herein but the embodiments described herein are not limited to any particular winning combinations.

Certain aspects, advantages, and novel features of the invention are described herein. It is to be understood that not necessarily all such advantages may be achieved in accordance with any particular embodiment of the invention. Thus, for example, those skilled in the art will recognize that the invention may be embodied or carried out in a manner that achieves one advantage or group of advantages as taught herein without necessarily achieving other advantages as may be taught or suggested herein.

Although several embodiments, examples and illustrations are disclosed below, it will be understood by those of ordinary skill in the art that the invention described herein extends beyond the specifically disclosed embodiments, examples and illustrations and includes other uses of the invention and obvious modifications and equivalents thereof. Embodiments of the invention(s) are described with reference to the accompanying figures, wherein like numerals refer to like elements throughout. The terminology used in the description presented herein is not intended to be interpreted in any limited or restrictive manner simply because it is being used in conjunction with a detailed description of certain specific embodiments of the invention(s). In addition, embodiments of the invention(s) can comprise several novel features and it is possible that no single feature is solely responsible for its desirable attributes or is essential to practicing the invention(s) herein described.

Throughout the description that follows and unless otherwise specified, the following terms may include and/or encompass the example meanings provided in this section. These terms and illustrative example meanings are provided to clarify the language selected to describe embodiments both in the specification and in the appended claims, and accordingly, are not intended to be limiting. Other terms are defined throughout the present description.

A "game", as the term is used herein unless specified otherwise, may comprise any game (e.g., wagering or non-wagering, electronically playable over a network) playable by one or more players in accordance with specified rules. A game may be playable on a personal computer online in web browsers, on a game console and/or on a mobile device such as a smart-phone or tablet computer. A game may also be playable on a dedicated gaming device (e.g., an electronic or non-electronic table for facilitating card games in a brick-and-mortar casino). "Gaming" thus refers to play of a game.

A "casual game", as the term is used herein unless specified otherwise, may comprise a game with simple rules with little or no time commitment on the time of a player to play. A casual game may feature, for example, very simple game play such as a puzzle or Scrabble™ game, may allow for short bursts of play (e.g., during work breaks), an ability to quickly reach a final stage and/or continuous play without a need to save the game.

A "social network game", as used herein unless specified otherwise, refers to a type of online game that is played through a social network, and in some embodiments may feature multiplayer and asynchronous game play mechanics. A "social network" may refer to an online service, online community, platform, or site that focuses on facilitating the building of social networks or social relations among people. A social network service may, for example, consist of a representation of each user (often a profile), his/her social links, and a variety of additional services. A social network may be web-based and provide means for users to interact over the Internet, such as e-mail and instant messaging. A social network game may in some embodiments be implemented as a browser game, but can also be implemented on other platforms such as mobile devices.

A "wagering game", as the term is used herein, may comprise a game on which a player can risk a wager or other consideration, such as, but not limited to: slot games, poker games, blackjack, baccarat, craps, roulette, lottery, bingo, keno, casino war, etc. A wager may comprise a monetary wager in the form of an amount of currency or any other tangible or intangible article having some value which may be risked on an outcome of a wagering game. "Gambling" or "wagering" refers to play of a wagering game.

The term "game provider", as used herein unless specified otherwise, refers to an entity or system of components which provides, or facilitates the provision of, games for play and/or facilitates play of such game by use of a network such as the Internet or a proprietary or closed networks (e.g., an intranet or wide area network). For example, a game provider may operate a website which provides games in a digital format over the Internet. In some embodiments in which a game comprising a wagering game is provided, a game provider may operate or facilitate a gambling website over which wagers are accepted and results of wagering games are provided.

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and /or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

A "session" comprises a period of time spanning a plurality of event instances, game instances, spins or turns of a game, the session having a defined start and defined end. An "event instance", "game instance", "session" or "turn" is triggered upon an initiation of, or request for, at least one result of the game by a player, such as an actuation of a "start" or "spin" mechanism, which initiation causes an outcome to be determined or generated (e.g., a random number generator is contacted or communicated with to identify, generate or determine a random number to be used to determine a result for the event instance). An event instance or turn may comprise an event instance or turn of a primary game or an event instance or turn of a bonus round, mode or feature of the game. Accordingly, a session may refer to a session of a primary game or a session of a bonus round, mode or feature of the game, depending on the context.

An "outcome" should be differentiated from a "result" in the present description in that an "outcome" is a representation of a "result", typically comprising one or more game elements or game symbols. For example, in a "fruit themed" game, a winning outcome (i.e., an outcome corresponding to some kind of award, prize or payout) may comprise a combination of three "cherry" symbols. The "result" of this outcome may be a payout of X credits awarded to the player associated with the game. In another example, in a card game an "outcome" of the game may comprise a plurality of cards defining the player's hand and the "result" corresponding to this outcome may be the payout or other prize, if any, corresponding to the particular plurality of cards that the player wins based on the cards in the player's hand. In a session embodiment, a session result may comprise a binary result (e.g., a player or game character wins or loses the session) and/or the particular award (or magnitude of award) won or earned by the player based on the session (e.g., the number of credits awarded to the player). It should be noted that the embodiments described herein encompass prizes which may comprise awards, payouts, discounts, eligibility, advancement in a game or other benefits (whether monetary or non-monetary, tangible or intangible) to a player and that any reference to a "prize", "award" or "payout" may refer to any or all of the foregoing, unless the context explicitly indicates otherwise.

A "bonus round", "bonus mode" or "bonus feature" of a game, as the terms are used interchangeably herein unless indicated otherwise, may refer to a secondary game, entry into which is triggered via one or more events which may occur in a base or primary game. Typically, a player may be able to qualify to play a bonus game based on one or more outcomes in a primary game, such as in a basic mode or a qualifying mode. A bonus round may be played in accordance with a set of rules that is different from those of a primary game, and may be accompanied by displays, colors, sounds, animated sequences, game play and/or prizes that are not part of the primary game. In one embodiment, a primary or base game application or program may include programming or instructions which will automatically begin a bonus round after the player has achieved a triggering event or qualifying condition in the base or primary game.

"Virtual currency" as the term is used herein unless indicated otherwise, refers to an in-game currency that may be used as part of a game or one or more games provided by a game provider as (i) currency for making wagers, and/or (ii) to purchase or access various in-game items, features or powers. References to an "award", "prize" and/or "payout" herein are intended to encompass such in the form of virtual currency, credits, real currency or any other form of value, tangible or intangible.

A "credit balance", as the term is used herein unless indicated otherwise, refers to (i) a balance of currency, whether virtual currency or real currency, usable for making wagers or purchases in the game (or relevant to the game), and/or (ii) another tracking mechanism for tracking a player's success or advancement in a game by deducting therefrom points or value for unsuccessful attempts at advancement and adding thereto points or value for successful attempts at advancement. A credit balance may be increased or replenished with funds external to the game. For example, a player may transfer funds to the credit balance from a financial account or a gaming establishment may add funds to the credit balance due to a promotion, award or gift to the player.

II. Description of Figures: Example Systems

Referring now to the figures, FIG. 1 depicts a block diagram of an example system 100 according to some embodiments. The system 100 may comprise a plurality of player devices 102*a*-102*n* in communication with a game server 110 via a network 104. For purposes of brevity, any or all of the player devices 102*a*-102*n* will be referred to as a player device 102 herein, even though the plurality of player devices 102*a*-102*n* may include different types of player devices (as described below). The game server 110 may also be operable to communicate with or access a database 140 (which may comprise one or more databases and/or tables and which may comprise a storage device distinct from (or be a component of) the game server 110). It should be noted that in some embodiments database 140 may be stored on a game server 110 while in other embodiments database 140 may be stored on another computing device with which game server 110 is operable to communicate in order to at least access the data in database 140 (e.g., another server device remote from game server 140, operable to determine outcomes for an event instance of a game). In some embodiments a processor (e.g., one or more microprocessors, one or more microcontrollers, one or more digital signal processors) of a player device 102 and/or game server 110 may receive instructions (e.g., from a memory or like device), and execute those instructions, thereby performing one or more processes defined by those instructions. Instructions may be embodied in, e.g., one or more computer programs and/or one or more scripts.

In some embodiments a game server 110 and/or one or more of the player devices 102 stores and/or has access to data useful for facilitating play of a game. For example, game server 110 and/or a player device 102 may store (i) one or more probability databases for determining one or more outcome(s) and/or results for an event instance, hand or turn of a game; (ii) a current state or status of a game or game session (e.g., an indication of one or more wagers a player has placed on a plurality of dealt cards, including, a selection of a card to be replaced, etc.); (iii) one or more user interfaces for use in a game; (iv) one or more game themes for a game and/or (v) profiles or other personal information associated with a player of a game. It should be noted that in some embodiments such data may be stored on the game server 110 and information based on such data may be output to a player device 102 during play of a game while in other embodiments a game program may be downloaded to a local memory of a player device 102 and thus such data may be stored on a player device 102 (e.g., in encrypted or other secure or tamper-resistant form).

A game server 110 may comprise a computing device for facilitating play of a game (e.g., by receiving an input from a player, determining an outcome for a game, causing an outcome of a game to be displayed on a player device, determining whether to replace a previously dealt card, facilitating a wager and/or a provision of a payout for a game). For example, the game server 110 may comprise a server computer operated by a game provider or another entity (e.g., a social network website not primarily directed at providing games). In some embodiments, the game server may determine an outcome for hand or game event of a game by requesting and receiving such an outcome from another remote server operable to provide such outcomes. For example, in one embodiment the game server may request a random or pseudo random number from another server device (e.g., a server device comprising a random number generator (RNG)) and may determine one or more cards to deal for the game event based on the random or pseudo random number. In another example, the game server may request an indication of dealt cards from another server device and receive an indication of the dealt cards to output for a particular hand or other game event. In some embodiments, the game server 110 may further be operable to more directly facilitate a game program for a game (e.g., a wagering game).

In accordance with some embodiments, in addition to administering or facilitating play of a game, a game server 110 may comprise one or more computing devices responsible for handling online processes such as, but not limited to: serving a website comprising one or more games to a player device and/or processing transactions (e.g., wagers, deposits into financial accounts, managing accounts, controlling games, etc.). In some embodiments, game server 110 may comprise two or more server computers operated by the same entity (e.g., one server being primarily for storing states of games in progress and another server being primarily for storing mechanisms for determining outcomes of games, such as a random number generator). Examples of processes that may be performed by the game server 110 (directly or indirectly) may include, but are not limited to: (i) determining a plurality of cards to be dealt for a game event or round of a game; (ii) placing the dealt cards into card positions and storing in memory which card or card value has been placed in which card position; (iii) receiving an indication of a wager from a player, including a card of the initially dealt cards selected by the player as a discarded card or card to be replaced; (iv) determining which predefined subsets of card positions are included in the player's wager (e.g., in some embodiments only a maximum allowable wager qualifies a player to win payouts for certain predefined subsets of card positions, in some embodiments a player may select and place a distinct wager on each available predefined subset of card positions); (v) revealing one or more cards to a player (e.g., by placing the one or more cards face-up; this can be done after a wager is received and, in some embodiments, prior to a wager being received for at least some of the dealt cards); (vi) authorizing a game program to be downloaded to a player device; (vii) dealing one or more cards to a dealer hand (in embodiments in which a dealer hand is utilized); (viii) determining whether the player's hand is a winning hand; and/or (ix) modifying (or directing a player device to modify) a game interface to output information to a player, such as the cards comprising the player's hand (e.g., turning each of the cards in the player's hand face up), indicating whether the player's hand is a winning hand, updating a credit meter to reflect a payout won by the player, etc. It should be noted that in some embodiments the player's hand comprises all of the cards dealt for a game event (e.g., all of the cards placed into the card positions configured in the triangle or pyramid arrangement). In embodiments which include at least one predefined subset of card positions within the entirety of card positions (e.g., one or more smaller sub-triangles of cards within the greater triangle formed by all of the card positions), the cards in a particular predefined subset may be considered a player sub-hand. In other embodiments, a player may be allowed to place distinct wager(s) on the one or more predefined subsets of card positions (e.g., on one or more of the sub-triangles within the greater triangle formed by all of the card positions) and the cards within a particular predefined sub-set of card positions may comprise a distinct player hand.

Turning now to a description of a player device 102, in accordance with some embodiments a player device 102 may comprise a computing device that is operable to execute or facilitate the execution of a game program and used or useful by an online player for accessing an online casino or other electronic (e.g., online) game provider. For example, a player device 102 may comprise a desktop computer, computer workstation, laptop, mobile device, tablet computer, Personal Digital Assistant (PDA) devices, cellular or other wireless telephones (e.g., the Apple™ iPhone™), video game consoles (e.g., Microsoft™ Xbox 360™, Sony™ PlayStation™, and/or Nintendo™ Wii™), and/or handheld or portable video game devices (e.g., Nintendo™ Game Boy™ or Nintendo™ DS™). A player device 102 may comprise and/or interface with various components such as input and output devices (each of which is described in detail elsewhere herein) and, in some embodiments, game server 110. A player device 102 may be a dedicated gaming device (e.g., a slot machine) or a non-dedicated gaming device (e.g., an iPad™). It should be noted that a game server 110 may be in communication with a variety of different types of player devices 102.

A player device 102 may be used to play a wagering or non-wagering game (e.g., a social or casual game) over a network and output information relating to the game to a player participating in the game (e.g., cards dealt and placed into card positions for a game event, a card dealt to replace a card discarded by a player during a game event, a credit balance of credits available for play of the game, etc.). Any and all information relevant to any of the aforementioned functions may be stored locally on one or more of the player devices 102 and/or may be accessed using one or more of the player devices 102 (in one embodiments such information being stored on, or provided via, the game server 110). In another embodiment, a player device 102 may store some or all of the program instructions for determining, for example, (i) that a player has placed a wager in a round of the game (and, in some embodiments, communicating an indication of such a wager to game server 110), (ii) the cards dealt for the game event (including, in at least some embodiments, at least one replacement card dealt for the game event); (iii) one or more results of wagers placed on the round of the game and/or (iv) one or more results of any side wagers placed on the round of the game. In some embodiments, the game server 110 may be operable to authorize the one or more player devices 102 to access such information and/or program instructions remotely via the network 104 and/or download from the game server 110 (e.g., directly or via an intermediary server such as a web server) some or all of the program code for executing one or more of the various functions described in this disclosure. In other embodiments, outcome and result determinations may be carried out by the game server 110 (or another server with which the game server 110 communicates) and the player devices 102 may be terminals for displaying to an associated player such outcomes and results and other graphics and data related to a game.

It should be noted that the one or more player devices 102 may each be located at the same location as at least one other player device 102 (e.g., such as in a casino or internet café) or remote from all other player devices 102. Similarly, any given player device may be located at the same location as the game server 110 or may be remote from the game server 110. It should further be noted that while the game server 110 may be useful or used by any of the player devices 102 to perform certain functions described herein, the game server 110 need not control any of the player devices 102. For example, in one embodiment the game server 110 may comprise a server hosting a website of an online casino accessed by one or more of the player devices 102.

In one embodiment, a game server 110 may not be necessary or desirable. For example, some embodiments described in this disclosure may be practiced on one or more player devices 102 without a central authority. In such an embodiment, any functions described herein as performed by a game server 110 and/or data described as stored on a game server 110 may instead be performed by or stored on one or more player devices 102. Additional ways of distributing information and program instructions among one or more player devices 102, a game server 110 and/or another server device will be readily understood by one skilled in the art upon contemplation of the present disclosure.

In one embodiment, neither a game server nor a player device is necessary or desirable. For example, a card game consistent with the embodiments described herein may be implemented on a physical, non-electronic card table which utilizes physical cards.

Figure 2:
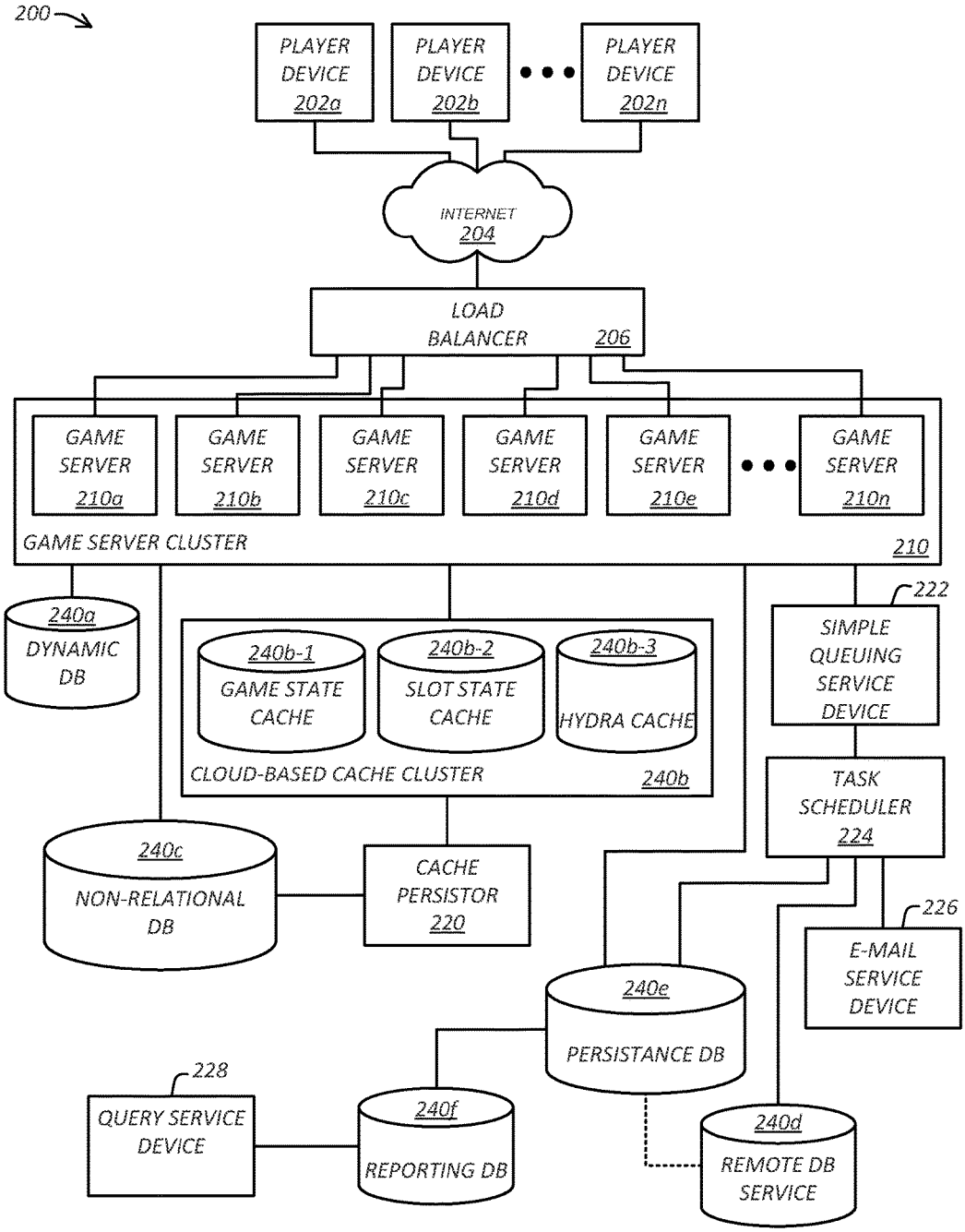
FIG. 2 is a schematic diagram of an embodiment of a social gaming platform in accordance with one or more embodiments described herein.

FIG. 2 a block diagram of an example system 200, which is consistent with some embodiments. In accordance with some embodiments, the system 200 may comprise a plurality of player devices 202*a-n*, the Internet 204, a load balancer 206, and/or a game server cluster 210. The game server cluster 210 may, in some embodiments, comprise a plurality of game servers 210*a-n*. In some embodiments, the system 200 may comprise a cache persistor 220, a Simple Queuing Service (SQS) device 222, a task scheduler 224, an e-mail service device 226, and/or a query service device 228. As depicted in FIG. 2, any or all of the various components 202*a-n*, 204, 206, 210*a-n*, 220, 222, 224, 226, 228 may be in communication with and/or coupled to one or more databases 240*a-f*. The system 200 may comprise, for example, a dynamic DataBase (DB) 240*a*, a cloud-based cache cluster 240*b* (e.g., comprising a game state cache 240*b*-1, a slot state cache 240*b*-2, and/or a "hydra" cache 240*b*-3), a non-relational DB 240*c*, a remote DB service 240*d*, a persistence DB 240*e*, and/or a reporting DB 240*f*.

According to some embodiments, any or all of the components 202*a-n*, 204, 206, 210*a-n*, 220, 222, 224, 226, 228, 240*a-f* of the system 200 may be similar in configuration and/or functionality to any similarly named and/or numbered components described herein. Fewer or more components 202*a-n*, 204, 206, 210*a-n*, 220, 222, 224, 226, 228, 240*a-f* (and/or portions thereof) and/or various configurations of the components 202*a-n*, 204, 206, 210*a-n*, 220, 222, 224, 226, 228, 240*a-f* may be included in the system 200 without deviating from the scope of embodiments described herein. While multiple instances of some components 202*a-n*, 210*a-n*, 240*a-f* are depicted and while single instances of other components 204, 206, 220, 222, 224, 226, 228 are depicted, for example, any component 202*a-n*, 204, 206, 210*a-n*, 220, 222, 224, 226, 228, 240*a-f* depicted in the system 200 may comprise a single device, a combination of devices and/or components 202*a-n*, 204, 206, 210*a-n*, 220, 222, 224, 226, 228, 240*a-f*, and/or a plurality of devices, as is or becomes desirable and/or practicable. Similarly, in some embodiments, one or more of the various components 202*a-n*, 204, 206, 210*a-n*, 220, 222, 224, 226, 228, 240*a-f* may not be needed and/or desired in the system 200.

According to some embodiments, the player device 202*a-n* may be utilized to access (e.g., via the Internet 204 and/or one or more other networks not explicitly shown) content provided by the game server cluster 210. The game server cluster 210 may, for example, provide, manage, host, and/or conduct various online and/or otherwise electronic games such as online bingo, slots, poker, and/or other games of chance, skill, and/or combinations thereof. In some embodiments, the various game servers 210*a-n* (virtual and/or physical) of the game server cluster 210 may be configured to provide, manage, host, and/or conduct individual instances of available game types. A first game server 210*a*, for example, may host a first particular instance of an online card game, a second game server 210*c* may host a second particular instance of an online card game, a third game server 210*c* may facilitate an online poker tournament, and/or a fourth game server 210*d* may provide an online slots game.

In some embodiments, the player devices 202*a-n* may comprise various components (hardware, firmware, and/or software; not explicitly shown) that facilitate game play and/or interaction with the game server cluster 210. The player device 202*a-n* may, for example, comprise a gaming client such as a software application programmed in Adobe® Flash® and/or HTML 5 that is configured to send requests to, and receive responses from, one or more of the game servers 210*a-n* of the game server cluster 210. In some embodiments, such an application operating on and/or via the player devices 202*a-n* may be configured in Model-View-Controller (MVC) architecture with a communication manager layer responsible for managing the requests to/responses from the game server cluster 210. In some embodiments, one or more of the game servers 210*a-n* may also or alternatively be configured in a MVC architecture with a communication manager and/or communications management layer. In some embodiments, communications between the player devices 202*a-n* and the game server cluster 210 may be conducted in accordance with the HyperText Transfer Protocol (HTTP) version 1.1 (HTTP/1.1) as published by the Internet Engineering Taskforce (IET) and the World Wide Web Consortium (W3C) in RFC 2616 (June 1999).

According to some embodiments, communications between the player devices 202*a-n* and the game server cluster 210 may be managed and/or facilitated by the load balancer 206. The load balancer 206 may, for example, route communications from player devices 202*a-n* to one or more of the specific game servers 210*a-n* depending upon various attributes and/or variables such as bandwidth availability (e.g., traffic management/volumetric load balancing), server load (e.g., processing load balancing), server functionality (e.g., contextual awareness/availability), and/or player-server history (e.g., session awareness/stickiness). In some embodiments, the load balancer 206 may comprise one or more devices and/or services provided by a third-party (not shown). The load balancer 206 may, for example, comprise an Elastic Load Balancer (ELB) service provided by Amazon® Web Services, LLC of Seattle, Wash. According to some embodiments, such as in the case that the load balancer 206 comprises the ELB or a similar service, the load balancer 206 may manage, set, determine, define, and/or otherwise influence the number of game servers 210*a-n* within the game server cluster 210. In the case that traffic and/or requests from the player devices 202*a-n* only require the first and second game servers 210*a-b*, for example, all other game servers 210*c-n* may be taken off-line, may not be initiated and/or called, and/or may otherwise not be required and/or utilized in the system 200. As demand increases (and/or if performance, security, and/or other issues cause one or more of the first and second game servers 210*a-b* to experience detrimental issues), the load balancer 206 may call and/or bring online one or more of the other game servers 210*c-n* depicted in FIG. 2. In the case that each game server 210*a-n* comprises an instance of an Amazon® Elastic Compute Cloud (EC2) service, the load balancer 206 may add or remove instances as is or becomes practicable and/or desirable.

In some embodiments, the load balancer 206 and/or the Internet 204 may comprise one or more proxy servers and/or devices (not shown in FIG. 2) via which communications between the player devices 202*a-n* and the game server cluster 210 are conducted and/or routed. Such proxy servers and/or devices may comprise one or more regional game hosting centers, for example, which may be geographically dispersed and addressable by player devices 202*a-n* in a given geographic proximity. In some embodiments, the proxy servers and/or devices may be located in one or more geographic areas and/or jurisdictions while the game server cluster 210 (and/or certain game servers 210*a-n* and/or groups of game servers 210*a-n* thereof) is located in a separate and/or remote geographic area and/or jurisdiction.

According to some embodiments, for some game types the game server cluster 210 may provide game outcomes to a controller device (not separately shown in FIG. 2) that times the release of game outcome information to the player devices 202*a-n* such as by utilizing a broadcaster device (also not separately shown in FIG. 2) that transmits the time-released game outcomes to the player devices 202*a-n* (e.g., in accordance with the Transmission Control Protocol (TCP) and Internet Protocol (IP) suite of communications protocols (TCP/IP), version 4, as defined by "Transmission Control Protocol" RFC 793 and/or "Internet Protocol" RFC 791, Defense Advance Research Projects Agency (DARPA), published by the Information Sciences Institute, University of Southern California, J. Postel, ed. (September 1981)).

In some embodiments, the game server cluster 210 (and/or one or more of the game servers 210*a-n* thereof) may be in communication with the dynamic DB 240*a*. According to some embodiments, the dynamic DB 240*a* may comprise a dynamically-scalable database service such as the DyanmoDB™ service provided by Amazon® Web Services, LLC. The dynamic DB 240*a* may, for example, store information specific to one or more certain game types (e.g., a reeled slots themed game) provided by the game server cluster 210 such as to allow, permit, and/or facilitate reporting and/or analysis of such information.

According to some embodiments, the game server cluster 210 (and/or one or more of the game servers 210*a-n* thereof) may be in communication with the cloud-based cache cluster 240*b*. Game state information from the game server cluster 210 may be stored in the game state cache 240*b*-1, for example, slot state (e.g., slot-game specific state) data may be stored in the slot state cache 240*b*-2, and/or other game and/or player information (e.g., progressive data, player rankings, audit data) may be stored in the hydra cache 240*b*-3. In some embodiments, the cache persistor 220 may move and/or copy data stored in the cloud-based cache cluster 240*b* to the non-relational DB 240*c*. The non-relational DB 240*c* may, for example, comprise a SimpleDB™ service provided by Amazon® Wed Services, LLC. According to some embodiments, the game server cluster 210 may generally access the cloud-based cache cluster 240*b* as-needed to store and/or retrieve game-related information. The data stored in the cloud-based cache cluster 240*b* may generally comprise a subset of the newest or freshest data, while the cache persistor 220 may archive and/or store or move such data to the non-relational DB 240*c* as it ages and/or becomes less relevant (e.g., once a player logs-off, once a game session and/or tournament ends). The game server cluster 210 may, in accordance with some embodiments, have access to the non-relational DB 240*c* as-needed and/or desired. The game servers 210*a-n* may, for example, be initialized with data from the non-relational DB 240*c* and/or may store and/or retrieve low frequency and/or low priority data via the non-relational DB 240*c*.

In some embodiments, the SQS device 222 may queue and/or otherwise manage requests, messages, events, and/or other tasks or calls to and/or from the server cluster 210. The SQS device 222 may, for example, prioritize and/or route requests between the game server cluster 210 and the task scheduler 224. In some embodiments, the SQS device 222 may provide mini-game and/or tournament information to the server cluster 210. According to some embodiments, the task scheduler 224 may initiate communications with the SQS device 222, the e-mail service provider 226 (e.g., providing e-mail lists), the remote DB service 240*d* (e.g., providing inserts and/or updates), and/or the persistence DB 240*e* (e.g., providing and/or updating game, player, and/or other reporting data), e.g., in accordance with one or more schedules.

According to some embodiments, the persistence DB 240*e* may comprise a data store of live environment game and/or player data. The game server cluster 210 and/or the task scheduler 224 or SQS device 222 may, for example, store game and/or player data to the persistence DB 240*e* and/or may pull and/or retrieve data from the persistence DB 240*e*, as-needed and/or desired. The server cluster 210 may, according to some embodiments, provide and/or retrieve card combinations and/or other game event info and/or configuration information via the persistence DB 240*e*.

In some embodiments, the reporting DB 240*f* may be created and/or populated based on the persistence DB 240*e*. On a scheduled and/or other basis, for example, a data transformation and/or mapping program may be utilized to pull data from the live environment (e.g., the persistence DB 240*e*) into the reporting DB 240*f*. The query service 228 may then be utilized, for example, to query the reporting DB 240*f*, without taxing the live environment and/or production system directly accessible by the game server cluster 210.

Figure 3:
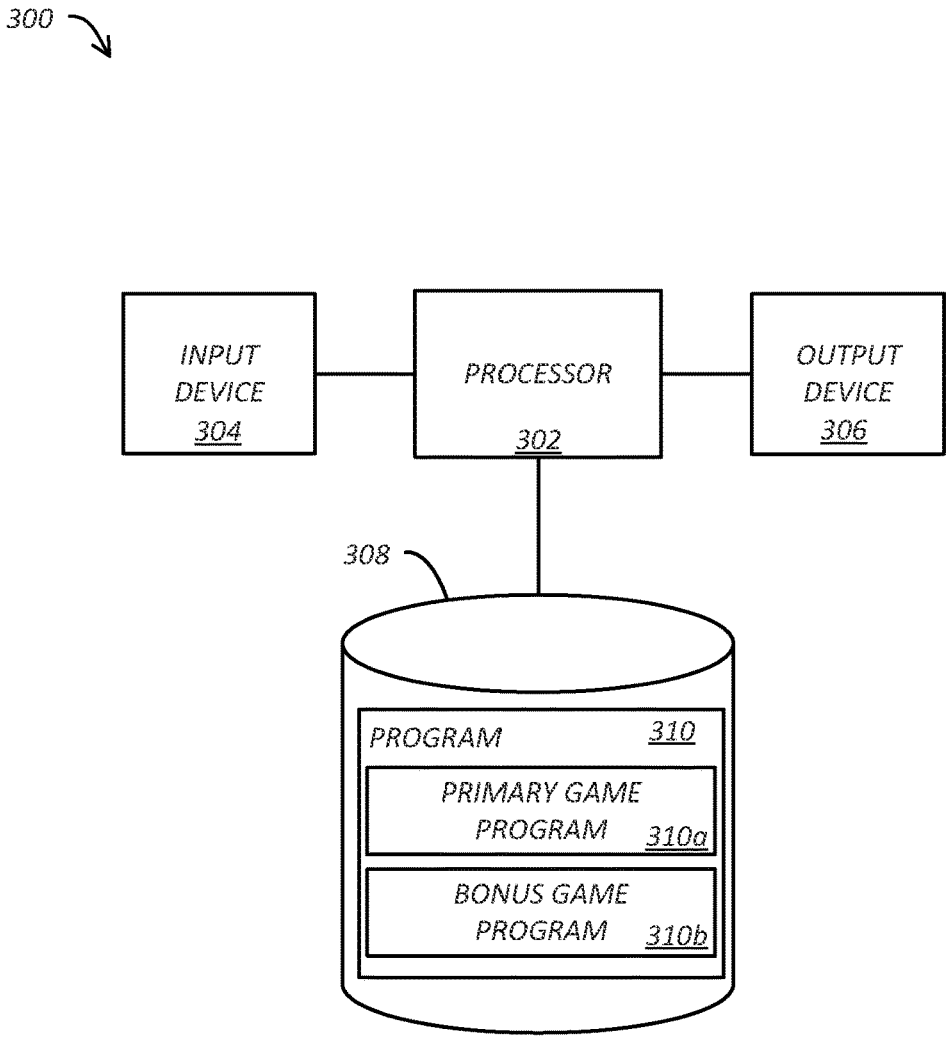
FIG. 3 is a block diagram of an embodiment of a computing device useful in a system according to one or more embodiments described herein.

FIG. 3 is a block diagram of an apparatus 300 according to some embodiments. In some embodiments, the apparatus 300 may be similar in configuration and/or functionality to any of the player devices 102, the game server 110 and/or another server device operable to facilitate the embodiments described herein. The apparatus 300 may, for example, execute, process, facilitate, and/or otherwise be associated with any of the process 500 described herein in conjunction with FIG. 5.

In some embodiments, the apparatus 300 may comprise a processor 302, an input device 304, an output device 306 and/or a memory device 308. Fewer or more components and/or various configurations of the components 302, 304, 306 and/or 308 may be included in the apparatus 300 without deviating from the scope of embodiments described herein.

According to some embodiments, the processor 302 may be or include any type, quantity, and/or configuration of processor that is or becomes known. The processor 302 may comprise, for example, an Intel® IXP 2800 network processor or an Intel® XEON™ Processor coupled with an Intel® E7501 chipset. In some embodiments, the processor 302 may comprise multiple inter-connected processors, microprocessors, and/or micro-engines. According to some embodiments, the processor 302 (and/or the apparatus 300 and/or other components thereof) may be supplied power via a power supply (not shown) such as a battery, an Alternating Current (AC) source, a Direct Current (DC) source, an AC/DC adapter, solar cells, and/or an inertial generator. In the case that the apparatus 302 comprises a server such as a blade server, necessary power may be supplied via a standard AC outlet, power strip, surge protector, and/or Uninterruptible Power Supply (UPS) device.

In some embodiments, the input device 304 and/or the output device 306 are communicatively coupled to the processor 302 (e.g., via wired and/or wireless connections and/or pathways) and they may generally comprise any types or configurations of input and output components and/or devices that are or become known, respectively.

The input device 304 may comprise, for example, a keyboard that allows an operator of the apparatus 300 to interface with the apparatus 200 (e.g., by a player, an employee or other worker affiliated with either an online casino or other entity operating a system which provides games to players). In some embodiments, the input device 304 may comprise a mechanism configured to indicate to a remote server device an initiation or triggering of an event instance or a request for a result of a game event (e.g., that a player has placed a wager for a game event and selected a card of the initially dealt cards to be replaced), such information being provided to the apparatus 300 and/or the processor 302. In such embodiments, the input device may comprise a key on a keyboard of the apparatus 300. Other examples of input devices include, but are not limited to: a game controller and/or gamepad, a bar-code scanner, a magnetic stripe reader, a pointing device (e.g., a computer mouse, touchpad, and/or trackball), a point-of-sale terminal keypad, a touch-screen, a microphone, an infrared sensor, a sonic ranger, a computer port, a video camera, a motion detector, a digital camera, a network card, a Universal Serial Bus (USB) port, a GPS receiver, a Radio Frequency Identification (RFID) receiver, a RF receiver, a thermometer, a pressure sensor, and a weight scale or mass balance.

The output device 306 may, according to some embodiments, comprise a display screen and/or other practicable output component and/or device that is operable to output information. The output device 306 may, for example, comprise a display screen via which is output a user interface for indication information to a player, such as values of cards or other outcomes, instructions, guidance, questions or other game-related information. Some examples of output devices that may be useful in some embodiments include a Cathode Ray Tube (CRT) monitor, a Liquid Crystal Display (LCD) screen, a Light Emitting Diode (LED) screen, a printer, an audio speaker, an Infra-red Radiation (IR) transmitter, an RF transmitter, and/or a data port. According to some embodiments, the input device 304 and/or the output device 306 may comprise and/or be embodied in a single device such as a touch-screen display or screen.

In some embodiments, the apparatus 300 may comprise any type or configuration of communication device and/or protocol (not shown) that is or becomes known or practicable. For example, the apparatus 300 may include a communication device such as a Network Interface Controller (NIC), a telephonic device, a cellular network device, a router, a hub, a modem, and/or a communications port or cable. In some embodiments, the communication device may be coupled to provide data to a telecommunications device. The communication device may, for example, comprise a cellular telephone network transmission device that sends signals (e.g., a placement of a wager and/or request for cards to be dealt and placed into card positions based on an input from a player) to a server (e.g., game server 110) in communication with a plurality of player devices 102. According to some embodiments, the communication device may also or alternatively be coupled to the processor 302. In some embodiments, the communication device may comprise an IR, RF, Bluetooth™, and/or Wi-Fi® network device coupled to facilitate communications between the processor 202 and another device.

The memory device 308 may comprise any appropriate information storage device that is or becomes known or available, including, but not limited to, units and/or combinations of magnetic storage devices (e.g., a hard disk drive), optical storage devices, and/or semiconductor memory devices such as Random Access Memory (RAM) devices, Read Only Memory (ROM) devices, Single Data Rate Random Access Memory (SDR-RAM), Double Data Rate Random Access Memory (DDR-RAM), and/or Programmable Read Only Memory (PROM).

The memory device 308 may, according to some embodiments, store a program 310 for facilitating one or more of the embodiments described herein, which program may include a primary game program 310*a* for facilitating a primary aspect of a game. In some embodiments, a game may further include a bonus round and the program 310 may further include a bonus round program 310*b* for facilitating the bonus round of the game. In some embodiments, the primary game program 310*a* and/or the bonus round program 310*b* may be utilized by the processor 302 to provide output information via the output device 306.

The primary game program 310*a* may, for example, provide instructions for determining at least one of: (i) a plurality of cards to be dealt for a round or event of a game (e.g., cards to be dealt into card positions upon which players may place bets); (ii) placement of the dealt cards into card positions arranged in an area forming a geometric shape (E.g., a two dimensional triangle); (iii) that a player has placed a wager for the round or event of the game; (iv) information based upon which a result for the game event may be determined (e.g., a selection by a player of at least one card to be replaced and an indication of a replacement card in response thereto); (v) determining a final composition and placement of cards (and their respective values) for a game event, including determining the combination of cards in each sub-area of the game interface for which a distinct wager and/or result may be determined; (vi) whether the player has won any prize based upon the final composition and the wager(s) placed by the player (e.g., by comparing the total combination of cards dealt for the game event and/or the combination of cards in each available sub-area to at least one table or other stored indication of winning categories of hands); (vi) whether a player has placed a side wager (e.g., based on an overlap of card positions in two or more wagers placed by the player for the game event); (vii) whether the player has selected any card(s) to be replaced; and/or (viii) whether any card values are to be revealed to the player and, if so, causing the appropriate card values to be revealed.

The apparatus 300 may function as a computer terminal and/or server of an online casino or other entity operating to provide online games, receive and/or manage information related to online games. In some embodiments, the apparatus 300 may comprise a web server and/or other server device operable to accept wagers and determine random numbers based upon which outcomes for wagering games are determined. In some embodiments, the apparatus 300 may comprise an apparatus that is operable to interact with a player of an online game. In some embodiments, apparatus 300 may comprise a plurality of devices working together to accomplish the functionality described herein with respect to FIG. 3.

Any or all of the exemplary instructions and data types described herein and other practicable types of data may be stored in any number, type, and/or configuration of memory devices that is or becomes known. The memory device 308 may, for example, comprise one or more data tables or files, databases, table spaces, registers, and/or other storage structures. In some embodiments, multiple databases and/or storage structures (and/or multiple memory devices 308) may be utilized to store information associated with the apparatus 300. According to some embodiments, the memory device 308 may be incorporated into and/or otherwise coupled to the apparatus 300 (e.g., as shown) or may simply be accessible to the apparatus 200 (e.g., externally located and/or situated).

Figure 4A:
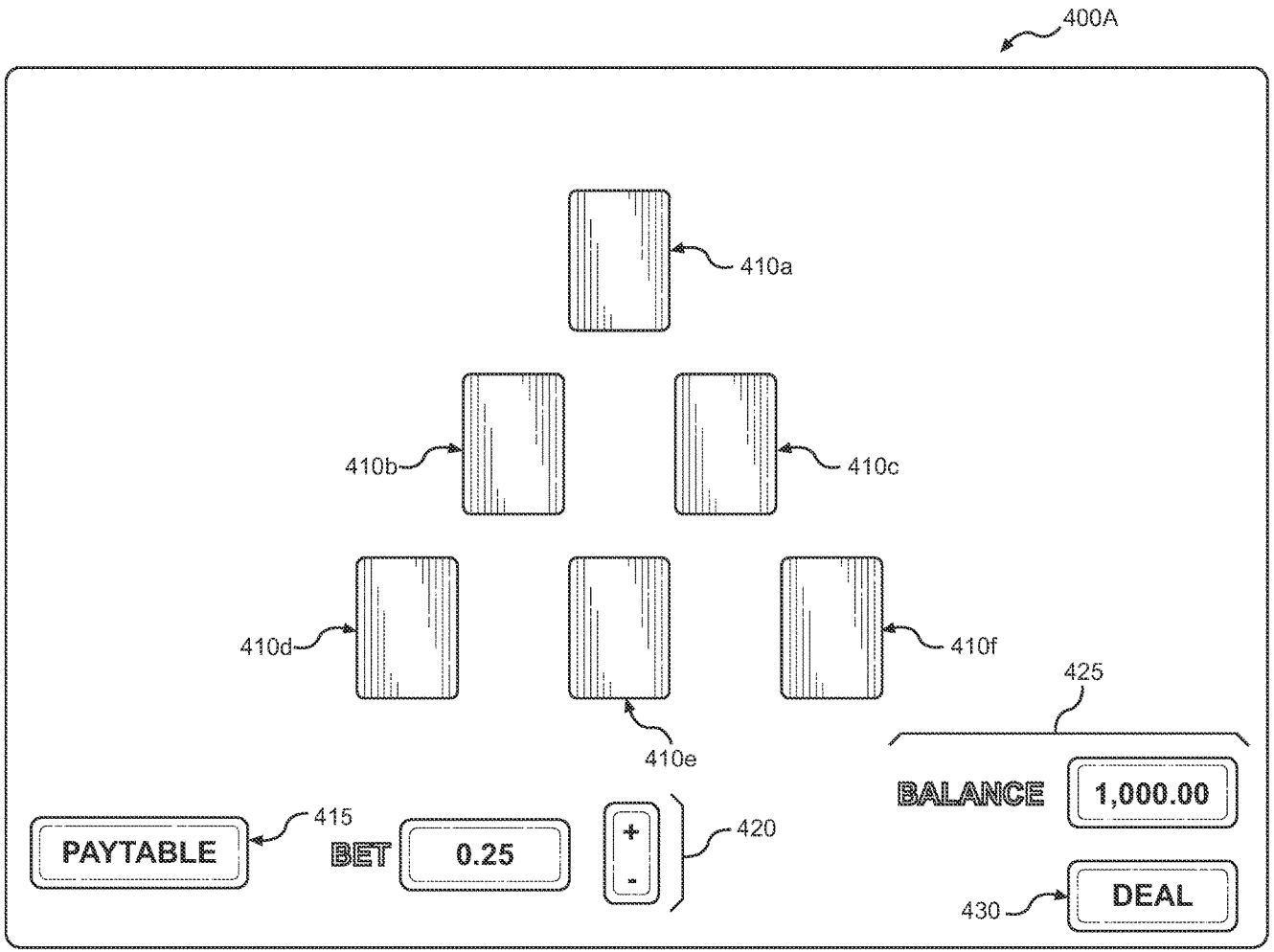
FIGS. 4A through 4D comprise an example embodiment of a possible layout for card positions in a game interface consistent with some embodiments described herein, illustrating a progression of an example game event.
Figure 4B:
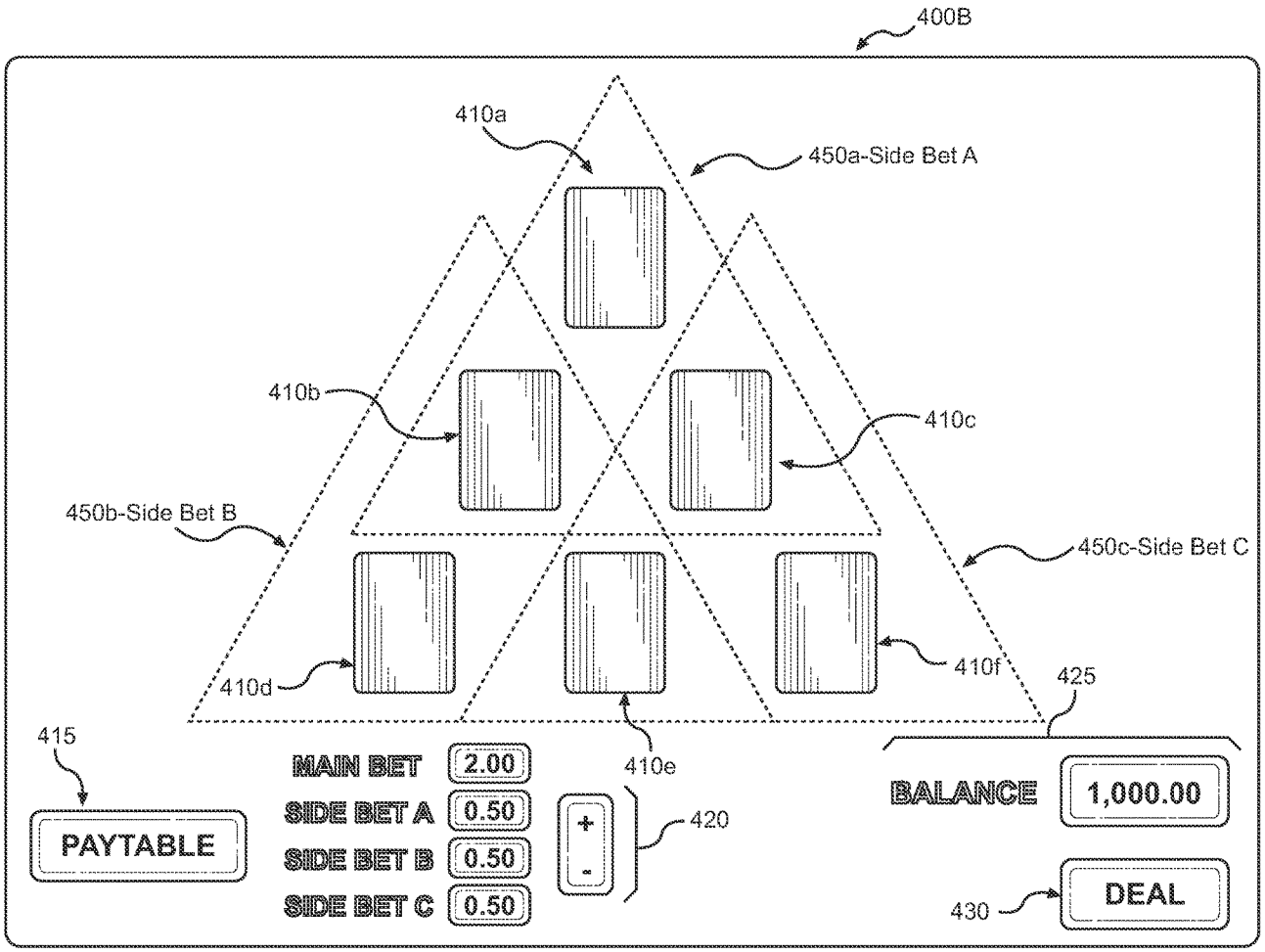
Figure 4C:
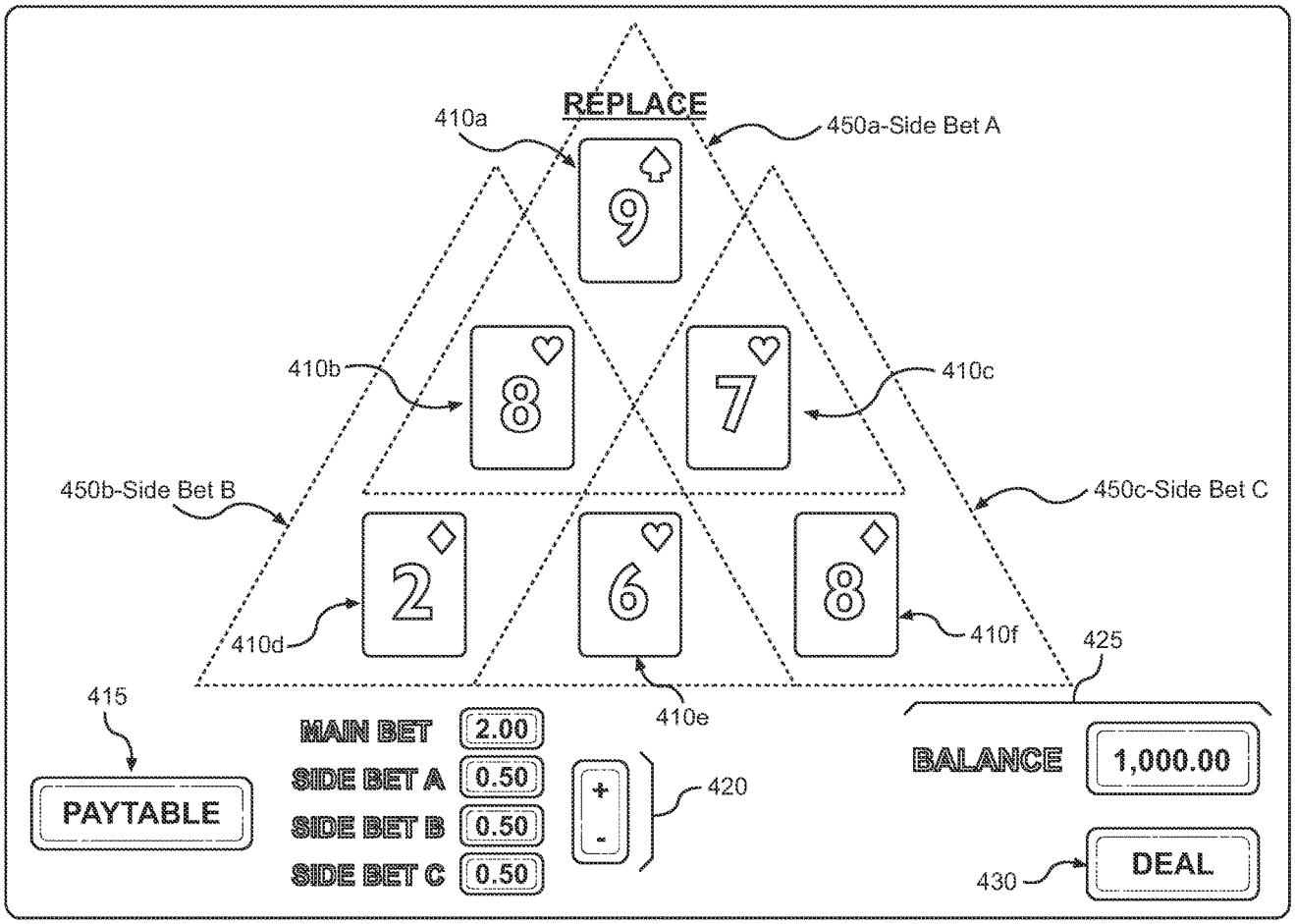
Figure 4D:
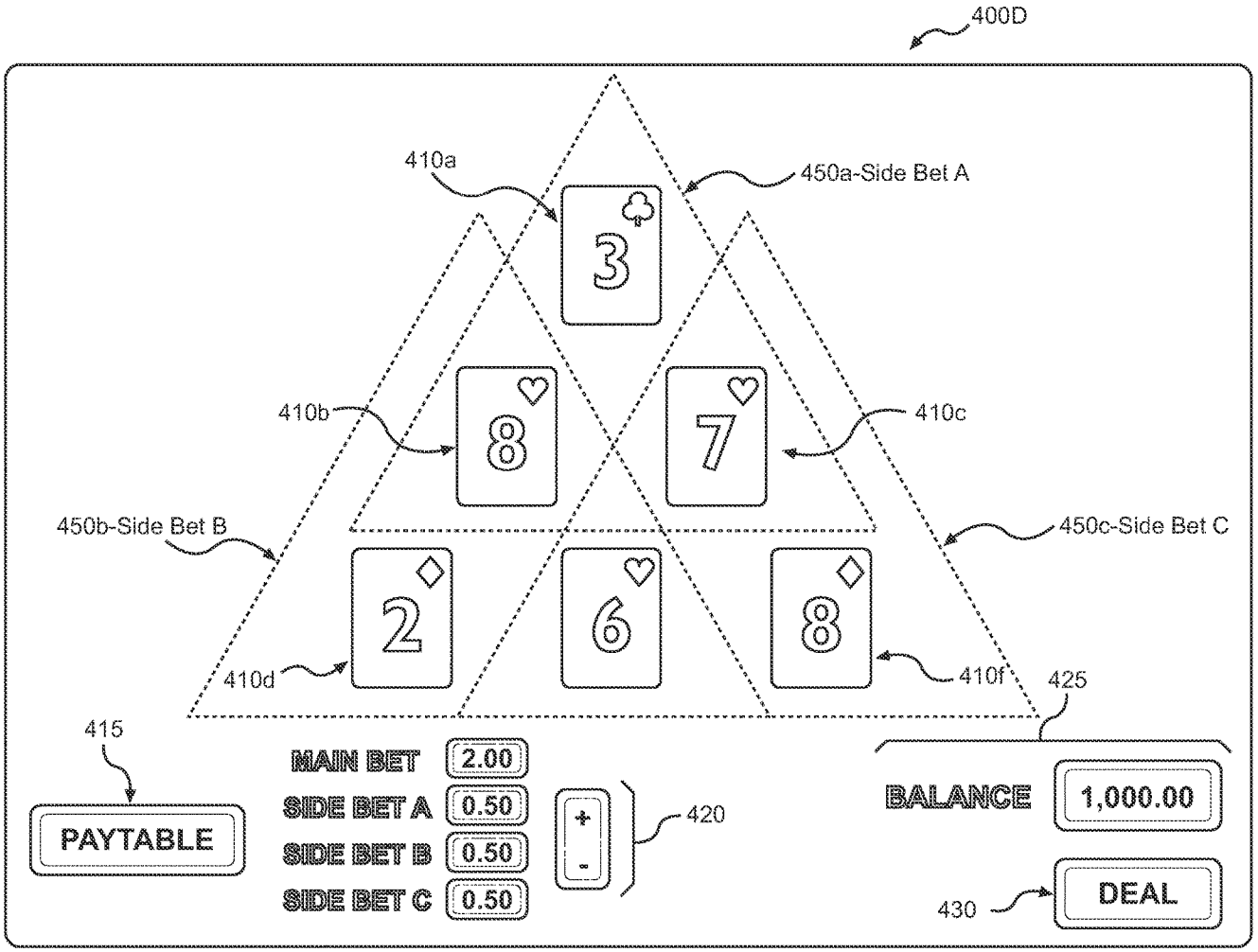

Turning now to FIGS. 4A through 4D, illustrated therein is an example game interface illustrating an example layout of card positions configured in an area forming a two-dimensional geometric shape comprising a triangle, into which card positions individual cards may be dealt during a game event and upon which game event one or more players may place one or more wagers in accordance with embodiments described herein. FIG. 4A comprises a state of the game interface at a first stage of a game event, before cards are dealt and placed into the available card positions (or before the card values of any placed cards are revealed to a player); FIG. 4B comprises a state of the game interface at the first stage of the game event but with an added indication of various sub-areas within which card combinations may be evaluated to determine whether they qualify for additional prizes or payouts; FIG. 4C illustrates a state of the game interface during a second stage of the game event, once the values of placed cards are revealed (as well as showing a card a player as selected for replacement); and FIG. 4D illustrates a state of the game interface during a third stage of the game event, once a replacement card has been dealt and placed and a final composition of cards for the game event is revealed. In the present application, like reference numerals in the Figures refer to like elements.

Although a card game as described herein may be implemented using an electronic representation of a card table layout in an electronic game (e.g., a card game playable online via a web browser) and FIGS. 4A through 4D illustrate various example layouts for an electronic game interface, in other embodiments such a card game may be implemented on a physical card table which may be configured (e.g., the felt layout may be arranged) in a manner similar to that shown in FIGS. 4A-4D.

Illustrated in FIGS. 4A through 4D is a particular and example game interface (referred to as game interface 400A with reference to FIG. 4A, game interface 400B with reference to FIG. 4B, etc.) which includes a plurality of card positions 410*a* through 410*f*, arranged in a triangle shaped configuration. In accordance with some embodiments, the dealt cards placed into the plurality of card positions 410*a*-410*f* are cards based upon which a player hand may be defined or a main combination of cards for a game event based upon which a prize or payout (if any) may be provided to a player. Although the game interface of FIGS. 4A-4F illustrates a six-card combination, the embodiments described herein are not limited to any particular combination of cards. For example, in another embodiment in which the card positions are arranged in a larger triangle-shaped area, another row of four card positions may be included in an additional bottom row, for a main combination of ten (10) cards dealt for a game event. Further, although a triangle-shaped configuration of card positions is illustrated, the embodiments described herein are not limited to such a shape and card positions may be arranged in a different geometric shape in other embodiments (e.g., an inverted pyramid, a square, etc.).

Game interfaces for facilitating a card game such as described herein (e.g., such as the game interface of FIGS. 4A-4D) may also include additional elements which may be helpful in facilitating the game or provide additional information to a player, some examples of which are illustrated. For example, an area or element of the game interface such as area 415 may be a selectable area which, if actuated or selected by a player, opens a new page or window to indicate the available payouts (and corresponding winning card combinations) for the game. In another example, an area or element of the game interface such as area 420 may serve as a mechanism for a player to indicate one or more wagers for the game (e.g., the player may utilize the "+/−" mechanism to increase or decrease the wager shown in a corresponding or currently selected "bet" window). Of course, any desirable mechanism for placing a wager or selecting a wager amount may be utilized. In some embodiments, a player placing a wager may be able to select an amount of the wager while in other embodiments the wager amount may be predetermined and not customizable or variable. In another example of an additional element which may be included in a game interface, an area 425 comprises an indication of an available credit balance of a player (an amount of credits or currency which is available to a player for wagering). In yet another example, a "deal" button such as that shown in area 430 may comprise a mechanism via which a player may request a new game event be initiated (e.g., a set of new cards be dealt into the card positions 410*a*-410*f* and the wager indicated in area 420 deducted from the player's credit balance shown in area 425).

Referring to FIG. 4A in particular, the game interface 400*a* shows six card positions arranged in a two-dimensional geometric shape comprising a triangle, with a bottom row comprising three card positions (410*d*, 410*e* and 4100, a middle row comprising two card positions (410*b* and 410*c*) and a top row comprising a single card position (410*a*). In accordance with some embodiments, the six cards dealt and placed into these card positions 410*a*-410*f* together define the main player hand or outcome for a main bet of a game event. Thus, a paytable for the game event may comprise sets of winning combinations of six cards which correspond to respective payouts (e.g., a six card straight, a straight flush, three pairs, two pair, etc.). It should be noted that the payouts and odds of any given winning combination may reflect that it is easier to obtain some winning combinations in six cards than the normal hand of five cards (e.g., two pair) and more difficult to obtain some winning combinations in six cards (e.g., a straight flush). In some embodiments, a winning combination of six cards may be at least partially based on a positional relationship of at least one first card to at least one second card (e.g., the at least one first card must satisfy a predetermined mathematical relationship with respect to the at least one second card). For example, in one embodiment a winning combination of cards may comprise a combination in which a sum of values of cards in the bottom row is less than the value of a card in the top row.

Turning now to FIG. 4B, illustrated therein is a game interface 400B, which shows a card as having been placed and revealed into each of the available symbol positions 410*a*-410*f* Additionally, the game interface 400B (as compare to the game interface 400A of FIG. 4A) indicates three different sub-areas defined by sub-combinations of card positions. A first sub-area 450*a* is defined by card positions

410*a*, 410*b* and 410*c*. A second sub-area 450*b* is defined by card positions 410*b*, 410*d* and 410*e*. A third sub-area 450*c* is defined by card positions 410*c*, 410*e* and 410*f* In accordance with some embodiments, each of the first area 450*a*, 450*b* and 450*c* comprises a smaller triangle within the larger triangle area formed by all of the six card positions 410*a*-410*f*.

In accordance with some embodiments, a player may place a side wager that a sub-combination of cards within a sub-area of the game interface may comprise a winning combination of cards. For example, in the example of FIG. 4B, a player may be allowed to place (i) a first side wager A that the three card positions defining sub-area 450*a* will include a winning combination of cards at the resolution of the game event; (ii) a second side wager B that the three card positions defining sub-area 450*b* will include a winning combination of cards at the resolution of the game event; and (iii) a third side wager C that the three card positions defining a sub-area 450*c* will include a winning combination of cards. In accordance with some embodiments, a player may place a distinct side wager on any or all of the sub-areas available in a game interface. Area 420 of FIG. 4B illustrates such an embodiment, providing a distinct game interface) and/or any and all of the sub-areas of the game interface. In some embodiments, a player may need to first qualify in order to be allowed to place side bets on sub-areas or sub-combinations of cards (e.g., the player must first place the maximum wager as the main bet). In some embodiments, in some circumstances a player may be automatically considered to qualify for payouts for winning combinations of cards in sub-areas (e.g., if the player a maximum allowable wager as the main bet, the player may automatically qualify for payouts for winning card combinations within at least one sub-area). In some embodiments, rather than placing additional wagers on side bets or sub-areas, a player may be allowed to allocate a portion of his main bet to at least one available side bet or sub-area. For example, in some embodiments if the player wagers $2.00 for the game event as his main wager, the player may be allowed to allocate (e.g., in set increments) how much of the $2.00 should be allocated to each of the available side bets or sub-areas. In some embodiments, a predetermined portion of a player's wager amount for a game event may be automatically attributed to at least one available side wager option. Payouts for sub-combinations of cards within sub-areas of the game interface may be at least partially based on a magnitude of the wager (or portion of a wager) allocated thereto.

In accordance with some embodiments, the odds and/or payout amounts utilized for a sub-combination of cards may reflect the different odds of obtaining certain categories of winning combinations of cards (e.g., a straight) with the lesser number of cards. For example, in a poker-type card game (a card game in which winning categories of cards include traditional poker-type categories, such as a flush and straight), a three (3) card sub-combination of cards may pay out at longer odds for Three of A Kind than would a five (5) or six (6) card combination but at shorter odds for all red cards, flushes or other categories of winning hands. In another example, a three (3) card sub-combination (as compared to a five (5) or six (6) card sub-combination of cards may result in a higher probability of obtaining a straight but the straight would be associated with a smaller payout or prize than would a straight obtained with a five (5) or six (6) card combination of cards. Thus, in some embodiments a first paytable may be accessed to determine a result (e.g., payout, if any) for a main wager or the entire combination of cards dealt for the game event (e.g., the six cards dealt in the embodiment of FIGS. 4A-4D) and a second paytable may be accessed to determine a result for a side wager defined by a smaller sub-combination of cards (e.g., a three card combination within one of the sub-areas of FIGS. 4A-4D).

Various winning combinations of cards are contemplated, whether within the larger or whole configuration of dealt cards (e.g., the six (6) card triangle of FIGS. 4A-4D) or within one or more sub-areas (e.g., the three smaller 2-1 triangles consisting of sub-areas 450*a*, 450*b* and 450*c* within the six (6) card triangle in FIGS. 4A-4D). For example, one type of winning card combination may be based on the numerical value of the cards within the configuration or sub-area being analyzed and determining whether they satisfy a predetermined mathematical relationship. In a more specific example of this type of winning combination, a combination of cards in a 2-1 sub-triangle may be determined to be a winning combination if the respective values of the two (2) cards in the bottom row sum to the value of the card in the top row. In another example, a winning combination of cards may comprise at least X cards (e.g., at least three (3) cards in the six (6) card configuration or all cards in a particular row, sub-area, etc.) if the cards have a common characteristic (e.g., if they are the same suit, color or numerical value). In some embodiments, a relatively larger payout may correspond to a relatively larger number of cards sharing a particular characteristic (e.g., a larger payout may be provided if six (6) of the six (6) dealt cards are of the same suit than if four (4) of the six (6) dealt cards are of the same suit).

In accordance with one embodiment, upon the dealt cards being turned face up (or the value of the cards being otherwise revealed to the player) the player is provided with an opportunity to select one (1) card of the dealt cards for replacement (e.g., for a newly dealt card). In other embodiments, the player may be allowed to select more than one card to have replaced (e.g., based on the rules of the game or based on whether the player has qualified to replace a plurality of cards, such as by achieving a predetermined player ranking, a minimum average or actual wager amount, winning the right to do so, etc.). In some embodiments the player may be allowed to select a card for replacement prior to the cards being analyzed for winning combinations and payouts being awarded; in other embodiments the player may be allowed to replace dealt cards after the initially dealt cards are analyzed for winning combinations and/or payouts are awarded. While in some embodiments which allow for at least one card to be replaced at the request of the player the player may only be awarded payouts or other prizes based on the placed cards after the replacement of the card(s) selected for replacement by the player (i.e., not based on the initially dealt cards prior to the replacement), in other embodiments the player may first be awarded payout(s) based on any winning combinations included in the initially dealt cards and then awarded any payout(s) resulting from the replaced of the card(s). In the latter embodiment (in which cards are only analyzed for winning combinations, and payouts are only awarded, after the one or more cards selected by the player are exchanged), the game may provide interesting strategy decisions for the player. For example, the player will need to be clever in his/her decision-making as changing one card can affect the outcome of two or more different sub-areas (e.g., sub-triangles). The player may also choose the volatility they prefer when deciding whether to exchange card(s) (and which card(s) to exchange) as changing certain cards may potentially result in bigger payouts but the cards they need may be fewer.

If the player chooses to exchange one of the dealt cards, the player selects the card and the selected card is removed from the configuration of dealt cards. It is replaced with another face-up card (or face down card which is subsequently turned face up). The replacement card may be dealt from the same deck as the cards which were originally dealt to the player or from a different deck. If the player chooses not to exchange a card(s), the initially dealt face up cards are evaluated to determine whether the player qualifies for a payout or other prize as a result of the dealt cards.

Turning now to FIG. 4C, illustrated therein is a game interface 400C which shows a state of the game event once it progresses past the state shown in FIG. 4B. In the state of the game event illustrated in FIG. 4C, the initially dealt cards have been revealed to the player and the player has been provided with an opportunity to replace at least one card. For example, the player may "click" or touch the card to be replaced, and the player's selection may be reflected or indicated by marking that card with a "REPLACE" or similar tag, thus allowing the player to unselect the card if the player changes his mind or had inadvertently selected a card for replacement). In the example of FIG. 4C, it is shown that the player participating in the example game event has selected the card in card position 410*a* for replacement. For purposes of the example, it can be assumed that one winning combination of cards for the main bet may comprise a combination in which all cards are of the same color. It can additionally be assumed that one winning sub-combination of cards corresponding to a payout is a three-card straight and that a payout for a three-card straight comprising a sub-combination is less than a payout for a six-card same-color card combination for all six cards. Thus, a player who has been dealt the cards shown in FIG. 4C may realize that, while he may be guaranteed a payout for the sub-combination of cards for side bet A (for the cards in card positions 410*a*, 410*b* and 410*c*; assuming the player's wager(s) qualify him/her to receive a payout for a winning sub-combination of cards in sub-area 450*a*) because these cards comprise a straight, the player may potentially win a bigger payout for six cards of the same color if he/she replaces the card in card position 410*a* and it is replaced with a diamond or heart card. In some embodiments in which the player is only provided with payout(s) for the card combinations after any card(s) are replaced (and not based on any winning combinations of cards resulting from the initially dealt and placed cards, if such winning combinations are no longer present after the replacing), this may be an interesting decision for a player because the player may need to decide whether to potentially forego a payout he/she has already qualified for as a result of the initially dealt cards in lieu of pursuing a potentially larger payout which he/she may qualify for based on replacement card(s).

Turning now to FIG. 4D, illustrated therein is a game interface 400D which shows a state of the game event once it progresses past the state shown in FIG. 4C. In the state of the game event illustrated in FIG. 4D, the initially dealt card placed in position 410*a* (a $9^S$) has been replaced with a $3^C$. In an embodiment in which a player is only provided payouts based on the final set of cards after the replacing of any card(s) selected by the player, the decision to replace the card in position 410*a* may be considered to have been a poor one, since the player did not qualify to receive a payout for six cards of the same color and the player no longer qualifies to receive a payout for a three-card straight in sub-area 450*a*. It should be noted, however, that the player may still (after the replacing of the card in card position 410*a*) qualify for a payout for the straight in sub-area 410*c* (comprising the card positions 410*c*, 410*e* and 4100 if the player's wager(s) encompass the Side Wager C.

Figure 5:
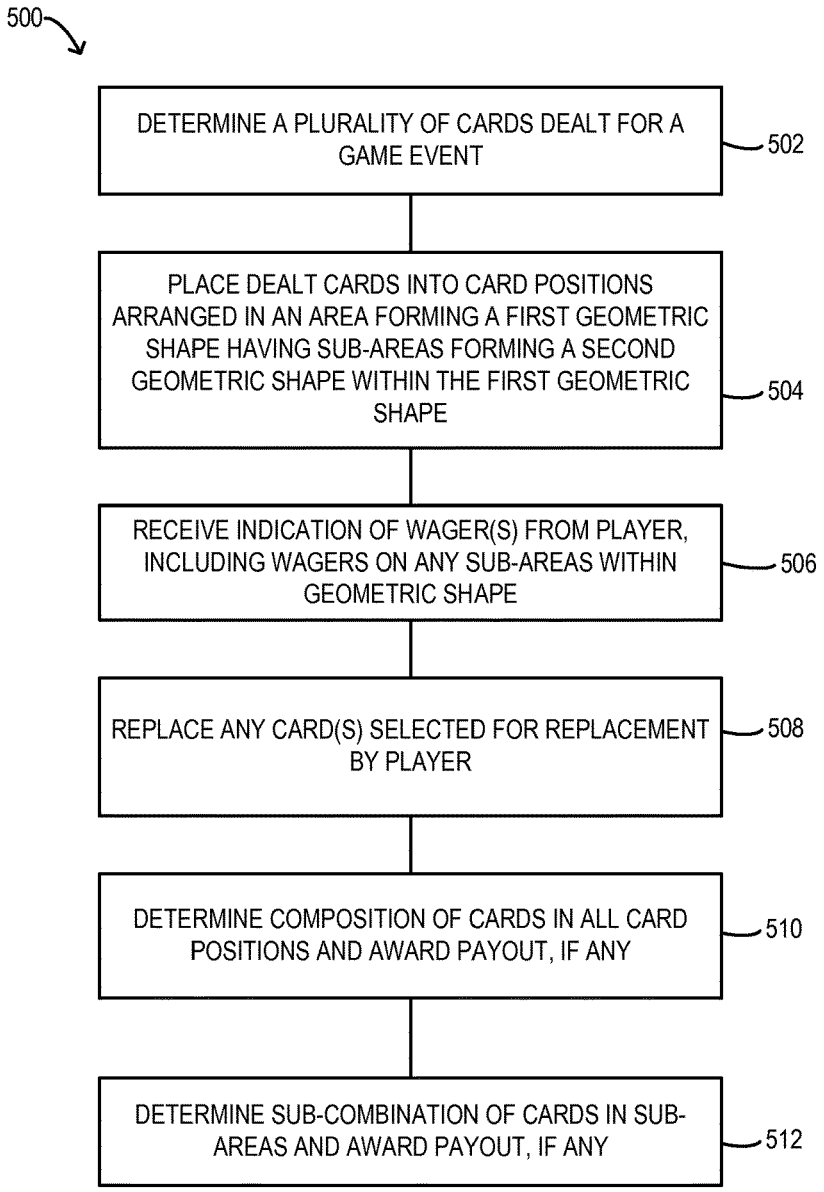
FIG. 5 is a flowchart of an example process consistent with one or more embodiments described herein.

Turning now to FIG. 5, illustrated therein is a process flowchart depicting an example process 500 which is consistent with some embodiments described herein. Process 500 facilitates a game event for a card game consistent with embodiments described herein, including the dealing of cards into a plurality of cards arranged in an area forming a geometric shape (e.g., a triangle) which comprises at least one sub-area within which winning combinations of cards may be evaluated. Process 500 may be performed, for example, by at least one of a server device operable to facilitate an electronic (e.g., online) card game and/or a player device enabling a player to play the electronic (e.g., online) card game. For example, process 500 may be performed by at least one of (i) a player device 102 (FIG. 1); (ii) a game server 110 (FIG. 1); (iii) a player device 202 (FIG. 2); (iv) a game server 210 (FIG. 2); and (v) apparatus 300 (FIG. 3). It should be noted that additional and/or different steps may be added to those depicted in the flowchart of FIG. 5 and that not all steps depicted are necessary to any embodiment described herein. Rather, process 500 is an example process of how some embodiments described herein may be implemented, and should not be taken in a limiting fashion. A person of ordinary skill in the art, upon contemplation of the embodiments described herein, may make various modifications to process 500 without departing from the spirit and scope of the embodiments in the possession of applicants.

The process 500 may begin, for example, by determining a plurality of cards dealt for a game event (502). In accordance with some embodiments, a plurality of cards may be dealt and made available for wagering upon. For example, as illustrated in FIGS. 4A-4D, six (6) cards may be dealt and placed face down and made available for wagering to one or more players (e.g., the dealt cards may be made available to online players participating in the card game remotely, such that any of the players may choose to place a wager for the game event). In some embodiments, the cards dealt for a particular game event are dealt for a particular player who is participating in (e.g., placing a wager upon) the game event while in other embodiments multiple players may wager upon the same set of cards dealt for a given game event. Of course the embodiments described herein are not dependent on any particular number of cards being dealt although the number of cards dealt may be selected based on what is reasonable to display in a game interface for a game event. Step 502 may comprise, for example, requesting and receiving the dealt cards, or data based upon which the dealt cards may be determined (such as a random number or pseudo random number) from another device (e.g., a second server if the process 500 is being performed by a first server and/or a player device). In one embodiment, the device which is performing step 502 may select or determine the dealt cards directly. In one embodiment, determining dealt cards may comprise determining cards dealt by an electronic shoe (an electronic device which shuffles and deals one or more decks of cards). In some embodiments the dealt cards may be determined from a single deck of cards while in other embodiments the dealt cards may be determined from a plurality of decks of cards.

In some embodiments, step 502 may comprise dealing or determining cards to be utilized for the game event based on decisions of the player or other events in the game event. For example, step 502 may include dealing at least one card to be used as a replacement card, if in an embodiment a feature allows a player to replace a card initially placed into the card positions. Such a card may not initially be placed but may be held in memory/reserve, for possible later use in the game event. In other embodiments, additional cards needed as a game event progresses (e.g., a replacement card) may be dealt later in the process in a distinct step, if such a card(s) is needed.

In step 504, at least some of the dealt cards determined in step 502 are placed into card positions which are arranged into an area forming a first geometric shape (e.g., a triangle, such as illustrated in FIGS. 4A-4D). In accordance with some embodiments, the area forming the first geometric shape may include within it sub-areas, each sub-area forming a second geometric shape (e.g., a smaller triangle within the larger triangle comprising the first geometric shape) and including a sub-set of the placed cards. The sub-areas or second geometric shapes may be located within (or mostly located within) the first geometric shape. In other words, the card positions for the card game bear a particular positional relationship to one another such that they are arranged in a configuration forming a geometric shape which may be divisible into smaller sub-areas which are smaller versions of the geometric shape (in other embodiments the sub-areas may form different geometric shapes from that formed by the first geometric shape). In some embodiments the cards may be placed in an order in which they were dealt while in other embodiments the cards may be placed in an order different from an order in which they were dealt (e.g., in random order or in accordance with another mechanism). The embodiments described herein are not dependent on any particular manner of placing the dealt cards in the game interface. In some embodiments, the dealing and placement of cards may be handled contemporaneously as effectively a single step in the process.

In some embodiments, all the dealt cards may initially be placed in a manner such that the value of the cards is not visible or otherwise discernible to the player (e.g., the cards may be placed face down) and may remain face down until betting for the game event is closed (i.e., until a stage in the game event when wagers are no longer accepted). In a single player embodiment in which a player is only allowed to place a single wager, the cards may remain face down until the player places his wager. In a multi-player embodiment, the cards may remain face down until all participating players have placed their wagers. In some embodiments, all cards may remain face down until the game interface indicates that wagers are no longer being accepted (e.g., a "bet" button or other mechanism for placing wagers is disabled or de-activated).

In some embodiments, some of the placed cards may initially (e.g., even before a wager is received from a player) be placed face up or otherwise in a manner which reveals to the player the value of these cards. For example, in some embodiments cards in certain predetermined card position(s) or randomly determined card position(s) may be placed face up.

In step 506, an indication of one or more wagers is received from a player. In accordance with some embodiments, multiple distinct wagers may be received from the same player for a particular game event. For example, a player may place a first wager may be for the totality of cards dealt (e.g., the main bet, that the cards dealt for the game event will include a winning combination or winning category of cards) at least one second wager on a particular sub-area of the game interface within which is located a sub-combination of the dealt cards, the at least one second wager being that the sub-combination of cards in the corresponding sub-area will include a winning combination or category of cards. In some embodiments, a single wager (e.g., if the player places a maximum wager) may qualify a player for any payouts won as a result of winning combinations of cards being present in the totality of dealt cards and/or any sub-combinations of cards dealt into defined sub-areas which are separately evaluated for winning combinations of cards. A player may place or indicate a wager, for example, via a betting mechanism such as those illustrated in areas 420 of game interface 400A (FIG. 4A) and/or 400B (FIG. 4B).

In step 508, it is determined whether the player has selected any cards placed into the card positions for replacement and, if so, replacing such cards. The selected card(s) may, for example, be replaced with newly dealt cards or cards previously dealt but not yet placed. In one embodiment, determining a replacement card may include communicating with another server device (e.g., to obtain a random or pseudo-random number based upon which the replacement card(s) may be selected or determined or to receive a more direct indication of the replacement card). Various techniques for determining a replacement card would be recognized by a person of ordinary skill in the art and the embodiments described herein are not limited to any particular mechanism for determining a replacement card. In some embodiments, a player may be provided an opportunity to provide a payment in exchange for being able to replace a card (if such opportunity is not included in the player's original wager) or to replace additional card(s). In some embodiments, only players and/or wagers which satisfy at least one predetermined criteria may qualify for allowing a replacement of one or more initially dealt cards. Examples of such criteria include, without limitation, a magnitude of a wager (for the game event, or an average or aggregate wager amount associated with the player), a ranking or category of a player, a triggering event within the game (e.g., a bonus feature which may be triggered only in some game events may allow for replacement of one or more initially dealt cards).

In step 510 the composition of the dealt and placed cards is determined (the totality of the cards dealt and placed being referred to as the player hand herein). For example, referring to FIG. 4D, the cards in each of positions 410*a*-410*f* may be evaluated to determine whether they correspond to any winning combinations or categories of cards. In some embodiments the cards comprising the player hand had been placed into the available card positions at an earlier point in the process. However, the embodiments described herein are not limited to any particular time at which cards are placed into card positions. For example, in some embodiments cards may be placed into card positions contemporaneously with, or even after, cards defining the player hand are determined. However and whenever the cards dealt for the game event are placed into particular card positions and replacement card(s) determined, the game program may store in memory (e.g., a temporary memory which stores information for a current status of a game event) an indication of the value of each card placed in each respective card positions. Thus, step 510 may comprise retrieving from memory or otherwise determining the respective values of the cards placed in the card positions defining the player hand (including, in some embodiments, any replacement card(s) placed to replace one or more initially dealt cards).

If it is determined that the player hand includes a winning combination of cards, a payout or other prize is provided to the player. Whether the player hand is a winning hand may be determined during one of the various steps in the process 500. In some embodiments, a player placing a wager on a game event is playing against a fixed paytable (much like in video poker or a slot machine game), with the paytable payouts being influenced by the number of cards defining the player's hand. Thus, for example, a paytable may include winning categories of hands (e.g., categories such as (or similar to) those illustrated in Table 2 herein). A player's hand may be determined to be a winning hand if it falls within any of the defined categories of winning hands (e.g., a Flush, a Straight, etc.) with an appropriate adjustment in the payout amount and/or odds for the player hand being a six-card hand rather than a five-card hand. In some embodiments, a player may select particular categories of hands (s)he is betting will be included in his/her player hand (e.g., a Flush). In such embodiments, payouts for the winning hand categories selected by the player may be influenced by the number of winning hand categories the player is including in their wager (e.g., a payout for a Flush may be higher if the player is only betting on a Flush occurring vs. if the player is betting on a Flush and additional winning categories of hands). In embodiments in which a player is playing against a paytable, determining whether a player hand is a winning hand may simply comprise comparing the composition of the player hand to the winning hands or categories of winning hands included in the appropriate paytable (e.g., the appropriate paytable or section of the paytable being selected or determined based on the wager amount associated with the player hand). In embodiments in which a player is playing against a fixed paytable, if the player hand matches or falls within a category of winning hands in the paytable, the corresponding payout (e.g., as indicated in the paytable) may be provided to the player (e.g., added to a credit meter balance or financial account associated with the player).

In step 512, the sub-combinations of cards in the sub-area(s) of the game interface (or, in some embodiments, the sub-areas encompassed within the player's wager(s)) are evaluated to determine if they correspond to any payout(s). This step may be similar to step 510 but may be performed separately for each predefined sub-area of card positions which may qualify for a payout (e.g., any or all of sub-areas 450*a*, 450*b* and 450*c* in FIGS. 4B-4D). In accordance with some embodiments, a different paytable or different area of a paytable may be utilized in step 512 than was used in step 510, to account for the fewer cards that are within a given sub-area of the game interface. For example, a flush for a three-card sub-combination may correspond to a smaller payout than a flush for a six-card combination. In some embodiments, the winning combinations or categories of cards for the sub-combinations of cards within the totality of placed cards may be different from those available for the totality of placed cards. For example, in some embodiments a positional and/or mathematical relationship of the cards within the sub-combination may be taken into account. In one particular example of a winning sub-combination of three cards, a winning sub-combination of cards may comprise cards in which the respective value of two of the cards (e.g., two cards forming a lower row within the sub-area comprising a triangle) sum to the value of the third card (e.g., the card forming the top row of the sub-area comprising the triangle).

As described herein, in some embodiments the number of cards included in a combination of cards being evaluated for whether it qualifies for a payout (e.g., whether it is the totality of placed cards or the cards within a predefined sub-area which form a sub-combination of cards for the game event) may influence the odds or payout magnitude associated with the corresponding wager. In some embodiments, the odds and/or payout may be impacted differently for different categories of winning hands. For example, in a poker-type card game a sub-combination of cards consisting of three (3) cards may payout out at longer odds for Three of A Kind than would a six (6) card player hand but at shorter odds for all red cards, flushes or other categories of winning hands. In another example, a three (3) card sub-combination of cards versus a six (6) card player hand may correspond to a higher probability of obtaining a straight but the straight would be associated with a smaller payout or prize than would a straight obtained with a six (6) card player hand. The odds and/or payout utilized for an evaluation of a player hand and/or a sub-combination of cards may be determined, for example, by (i) calculating such dynamically based on a stored algorithm; or (ii) selecting one of a plurality of available payout or probability tables for use in determining a result of the wager (e.g., a game program may access a first payout table for determining a result of a three (3) card sub-combination, a second payout table for determining a result of a four (4) card sub-combination, a third payout table for determining a result of a six (6) card player hand, etc.).

In some embodiments, the initially dealt cards may be evaluated for any winning combinations and corresponding payouts may be provided based on the initially dealt cards (e.g., as described in steps 510 and 512), prior to a player selecting any cards for replacement. In such embodiments, the placed cards may subsequently be re-evaluated after the appropriate cards are replaced, to determine whether any different or additional winning combinations or categories of cards have been created as a result of the replacement(s), whether in the totality of the card positions or sub-areas of card positions.

At some point in the process 500, at least some of the dealt cards which have been placed in card positions are revealed to a player who has placed a wager on the game event for which the cards have been dealt (e.g., the cards are turned face up so that the suit and rank of the cards is known to the player). In some embodiments, the cards are revealed to the player concurrently with an indication of a result of the game event being output (e.g., the cards are flipped over as the player is informed of whether (s)he has won any payouts as a result of the game event. In other embodiments cards are revealed upon an occurrence of another predetermined stage, phase or sub-event of the game event (e.g., once betting is closed for the game event).

Rules of Interpretation

The terms "information" and "data", as used herein unless specified otherwise, may be used interchangeably and may refer to any data, text, voice, video, image, message, bit, packet, pulse, tone, waveform, and/or other type or configuration of signal and/or information. Information may comprise information packets transmitted, for example, in accordance with the Internet Protocol Version 6 (IPv6) standard as defined by "Internet Protocol Version 6 (IPv6) Specification" RFC 1883, published by the Internet Engineering Task Force (IETF), Network Working Group, S. Deering et al. (December 1995). Information may, according to some embodiments, be compressed, encoded, encrypted, and/or otherwise packaged or manipulated in accordance with any method that is or becomes known or practicable.

The term "indication", as used herein unless specified otherwise, may refer to any indicia and/or other information indicative of or associated with a subject, item, entity, and/or other object and/or idea. As used herein, the phrases "information indicative of" and "indicia" may be used to refer to any information that represents, describes, and/or is otherwise associated with a related entity, subject, or object. Indicia of information may include, for example, a code, a reference, a link, a signal, an identifier, and/or any combination thereof and/or any other informative representation associated with the information. In some embodiments, indicia of information (or indicative of the information) may be or include the information itself and/or any portion or component of the information. In some embodiments, an indication may include a request, a solicitation, a broadcast, and/or any other form of information gathering and/or dissemination.

The term "network component," as used herein unless specified otherwise, may refer to a user or network device, or a component, piece, portion, or combination of user or network devices. Examples of network components may include a Static Random Access Memory (SRAM) device or module, a network processor, and a network communication path, connection, port, or cable.

In addition, some embodiments are associated with a "network" or a "communication network". As used herein, the terms "network" and "communication network" may be used interchangeably and may refer to any object, entity, component, device, and/or any combination thereof that permits, facilitates, and/or otherwise contributes to or is associated with the transmission of messages, packets, signals, and/or other forms of information between and/or within one or more network devices. Networks may be or include a plurality of interconnected network devices. In some embodiments, networks may be hard-wired, wireless, virtual, neural, and/or any other configuration of type that is or becomes known. Communication networks may include, for example, one or more networks configured to operate in accordance with the Fast Ethernet LAN transmission standard 802.3-2002® published by the Institute of Electrical and Electronics Engineers (IEEE). In some embodiments, a network may include one or more wired and/or wireless networks operated in accordance with any communication standard or protocol that is or becomes known or practicable.

The term "player," as used herein unless specified otherwise, may refer to any type, quantity, and or manner of entity associated with the play of a game. In some embodiments, a player may comprise an entity (i) conducting play of an online game, (ii) that desires to play a game (e.g., an entity registered and/or scheduled to play and/or an entity having expressed interest in the play of the game—e.g., a spectator) and/or may (iii) that configures, manages, and/or conducts a game. A player may be currently playing a game or have previously played the game, or may not yet have initiated play—i.e., a "player" may comprise a "potential player" (e.g., in general and/or with respect to a specific game). In some embodiments, a player may comprise a user of an interface (e.g., whether or not such a player participates in a game or seeks to participate in the game). In some embodiments, a player may comprise a virtual player (i.e., a player represented by software controlling betting decisions for a player position).

Some embodiments described herein are associated with a "player device" or a "network device". As used herein, a "player device" is a subset of a "network device". The "network device", for example, may generally refer to any device that can communicate via a network, while the "player device" may comprise a network device that is owned and/or operated by or otherwise associated with a player. Examples of player and/or network devices may include, but are not limited to: a Personal Computer (PC), a computer workstation, a computer server, a printer, a scanner, a facsimile machine, a copier, a Personal Digital Assistant (PDA), a storage device (e.g., a disk drive), a hub, a router, a switch, and a modem, a video game console, or a wireless or cellular telephone. Player and/or network devices may, in some embodiments, comprise one or more network components.

Numerous embodiments are described in this disclosure, and are presented for illustrative purposes only. The described embodiments are not, and are not intended to be, limiting in any sense. The presently disclosed invention(s) are widely applicable to numerous embodiments, as is readily apparent from the disclosure. One of ordinary skill in the art will recognize that the disclosed invention(s) may be practiced with various modifications and alterations, such as structural, logical, software, and electrical modifications. Although particular features of the disclosed invention(s) may be described with reference to one or more particular embodiments and/or drawings, it should be understood that such features are not limited to usage in the one or more particular embodiments or drawings with reference to which they are described, unless expressly specified otherwise.

The present disclosure is neither a literal description of all embodiments nor a listing of features of the invention that must be present in all embodiments.

The Title (set forth at the beginning of the first page of this disclosure) is not to be taken as limiting in any way as the scope of the disclosed invention(s).

The term "product" means any machine, manufacture and/or composition of matter as contemplated by 35 U.S.C. § 101, unless expressly specified otherwise.

The terms "an embodiment", "embodiment", "embodiments", "the embodiment", "the embodiments", "one or more embodiments", "some embodiments", "one embodiment" and the like mean "one or more (but not all) disclosed embodiments", unless expressly specified otherwise.

The terms "the invention" and "the present invention" and the like mean "one or more embodiments of the present invention."

A reference to "another embodiment" in describing an embodiment does not imply that the referenced embodiment is mutually exclusive with another embodiment (e.g., an embodiment described before the referenced embodiment), unless expressly specified otherwise.

The terms "including", "comprising" and variations thereof mean "including but not limited to", unless expressly specified otherwise.

The terms "a", "an" and "the" mean "one or more", unless expressly specified otherwise.

The term "and/or", when such term is used to modify a list of things or possibilities (such as an enumerated list of possibilities) means that any combination of one or more of the things or possibilities is intended, such that while in some embodiments any single one of the things or possibilities may be sufficient in other embodiments two or more (or even each of) the things or possibilities in the list may be preferred, unless expressly specified otherwise. Thus for example, a list of "a, b and/or c" means that any of the following interpretations would be appropriate: (i) each of "a", "b" and "c"; (ii) "a" and "b"; (iii) "a" and "c"; (iv) "b" and "c"; (v) only "a"; (vi) only "b"; and (vii) only "c."

The term "plurality" means "two or more", unless expressly specified otherwise.

The term "herein" means "in the present disclosure, including anything which may be incorporated by reference", unless expressly specified otherwise.

The phrase "at least one of", when such phrase modifies a plurality of things (such as an enumerated list of things)

means any combination of one or more of those things, unless expressly specified otherwise. For example, the phrase at least one of a widget, a car and a wheel means either (i) a widget, (ii) a car, (iii) a wheel, (iv) a widget and a car, (v) a widget and a wheel, (vi) a car and a wheel, or (vii) a widget, a car and a wheel.

The phrase "based on" does not mean "based only on", unless expressly specified otherwise. In other words, the phrase "based on" describes both "based only on" and "based at least on".

Each process (whether called a method, algorithm or otherwise) inherently includes one or more steps, and therefore all references to a "step" or "steps" of a process have an inherent antecedent basis in the mere recitation of the term 'process' or a like term. Accordingly, any reference in a claim to a 'step' or 'steps' of a process has sufficient antecedent basis.

When an ordinal number (such as "first", "second", "third" and so on) is used as an adjective before a term, that ordinal number is used (unless expressly specified otherwise) merely to indicate a particular feature, such as to distinguish that particular feature from another feature that is described by the same term or by a similar term. For example, a "first widget" may be so named merely to distinguish it from, e.g., a "second widget". Thus, the mere usage of the ordinal numbers "first" and "second" before the term "widget" does not indicate any other relationship between the two widgets, and likewise does not indicate any other characteristics of either or both widgets. For example, the mere usage of the ordinal numbers "first" and "second" before the term "widget" (1) does not indicate that either widget comes before or after any other in order or location; (2) does not indicate that either widget occurs or acts before or after any other in time; and (3) does not indicate that either widget ranks above or below any other, as in importance or quality. In addition, the mere usage of ordinal numbers does not define a numerical limit to the features identified with the ordinal numbers. For example, the mere usage of the ordinal numbers "first" and "second" before the term "widget" does not indicate that there must be no more than two widgets.

When a single device, component or article is described herein, more than one device, component or article (whether or not they cooperate) may alternatively be used in place of the single device, component or article that is described. Accordingly, the functionality that is described as being possessed by a device may alternatively be possessed by more than one device, component or article (whether or not they cooperate).

Similarly, where more than one device, component or article is described herein (whether or not they cooperate), a single device, component or article may alternatively be used in place of the more than one device, component or article that is described. For example, a plurality of computer-based devices may be substituted with a single computer-based device. Accordingly, the various functionality that is described as being possessed by more than one device, component or article may alternatively be possessed by a single device, component or article.

The functionality and/or the features of a single device that is described may be alternatively embodied by one or more other devices that are described but are not explicitly described as having such functionality and/or features. Thus, other embodiments need not include the described device itself, but rather can include the one or more other devices which would, in those other embodiments, have such functionality/features.

Devices that are in communication with each other need not be in continuous communication with each other, unless expressly specified otherwise. On the contrary, such devices need only transmit to each other as necessary or desirable, and may actually refrain from exchanging data most of the time. For example, a machine in communication with another machine via the Internet may not transmit data to the other machine for weeks at a time. In addition, devices that are in communication with each other may communicate directly or indirectly through one or more intermediaries.

A description of an embodiment with several components or features does not imply that all or even any of such components and/or features are required. On the contrary, a variety of optional components are described to illustrate the wide variety of possible embodiments of the present invention(s). Unless otherwise specified explicitly, no component and/or feature is essential or required.

Further, although process steps, algorithms or the like may be described in a sequential order, such processes may be configured to work in different orders. In other words, any sequence or order of steps that may be explicitly described does not necessarily indicate a requirement that the steps be performed in that order. The steps of processes described herein may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

Although a process may be described as including a plurality of steps, that does not indicate that all or even any of the steps are essential or required. Various other embodiments within the scope of the described invention(s) include other processes that omit some or all of the described steps. Unless otherwise specified explicitly, no step is essential or required.

Although a product may be described as including a plurality of components, aspects, qualities, characteristics and/or features, that does not indicate that all of the plurality are essential or required. Various other embodiments within the scope of the described invention(s) include other products that omit some or all of the described plurality.

An enumerated list of items (which may or may not be numbered) does not imply that any or all of the items are mutually exclusive, unless expressly specified otherwise. Likewise, an enumerated list of items (which may or may not be numbered) does not imply that any or all of the items are comprehensive of any category, unless expressly specified otherwise. For example, the enumerated list "a computer, a laptop, a PDA" does not imply that any or all of the three items of that list are mutually exclusive and does not imply that any or all of the three items of that list are comprehensive of any category.

Headings of sections provided in this disclosure are for convenience only, and are not to be taken as limiting the disclosure in any way.

"Determining" something can be performed in a variety of manners and therefore the term "determining" (and like terms) includes calculating, computing, deriving, looking up (e.g., in a table, database or data structure), ascertaining, recognizing, and the like.

A "display" as that term is used herein is an area that conveys information to a viewer. The information may be dynamic, in which case, an LCD, LED, CRT, Digital Light Processing (DLP), rear projection, front projection, or the like may be used to form the display. The aspect ratio of the display may be 4:3, 16:9, or the like. Furthermore, the resolution of the display may be any appropriate resolution such as 480i, 480p, 720p, 1080i, 1080p or the like. The format of information sent to the display may be any appropriate format such as Standard Definition Television (SDTV), Enhanced Definition TV (EDTV), High Definition TV (HDTV), or the like. The information may likewise be static, in which case, painted glass may be used to form the display. Note that static information may be presented on a display capable of displaying dynamic information if desired. Some displays may be interactive and may include touch screen features or associated keypads as is well understood.

The present disclosure may refer to a "control system" or program. A control system or program, as that term is used herein, may be a computer processor coupled with an operating system, device drivers, and appropriate programs (collectively "software") with instructions to provide the functionality described for the control system. The software is stored in an associated memory device (sometimes referred to as a computer readable medium). While it is contemplated that an appropriately programmed general purpose computer or computing device may be used, it is also contemplated that hard-wired circuitry or custom hardware (e.g., an application specific integrated circuit (ASIC)) may be used in place of, or in combination with, software instructions for implementation of the processes of various embodiments. Thus, embodiments are not limited to any specific combination of hardware and software.

A "processor" means any one or more microprocessors, Central Processing Unit (CPU) devices, computing devices, microcontrollers, digital signal processors, or like devices. Exemplary processors are the INTEL PENTIUM or AMD ATHLON processors.

The term "computer-readable medium" refers to any statutory medium that participates in providing data (e.g., instructions) that may be read by a computer, a processor or a like device. Such a medium may take many forms, including but not limited to non-volatile media, volatile media, and specific statutory types of transmission media. Non-volatile media include, for example, optical or magnetic disks and other persistent memory. Volatile media include DRAM, which typically constitutes the main memory. Statutory types of transmission media include coaxial cables, copper wire and fiber optics, including the wires that comprise a system bus coupled to the processor. Common forms of computer-readable media include, for example, a floppy disk, a flexible disk, hard disk, magnetic tape, any other magnetic medium, a CD-ROM, Digital Video Disc (DVD), any other optical medium, punch cards, paper tape, any other physical medium with patterns of holes, a RAM, a PROM, an EPROM, a FLASH-EEPROM, a USB memory stick, a dongle, any other memory chip or cartridge, a carrier wave, or any other medium from which a computer can read. The terms "computer-readable memory" and/or "tangible media" specifically exclude signals, waves, and wave forms or other intangible or non-transitory media that may nevertheless be readable by a computer.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols. For a more exhaustive list of protocols, the term "network" is defined below and includes many exemplary protocols that are also applicable here.

It will be readily apparent that the various methods and algorithms described herein may be implemented by a control system and/or the instructions of the software may be designed to carry out the processes of the present invention.

Where databases are described, it will be understood by one of ordinary skill in the art that (i) alternative database structures to those described may be readily employed, and (ii) other memory structures besides databases may be readily employed. Any illustrations or descriptions of any sample databases presented herein are illustrative arrangements for stored representations of information. Any number of other arrangements may be employed besides those suggested by, e.g., tables illustrated in drawings or elsewhere. Similarly, any illustrated entries of the databases represent exemplary information only; one of ordinary skill in the art will understand that the number and content of the entries can be different from those described herein. Further, despite any depiction of the databases as tables, other formats (including relational databases, object-based models, hierarchical electronic file structures, and/or distributed databases) could be used to store and manipulate the data types described herein. Likewise, object methods or behaviors of a database can be used to implement various processes, such as those described herein. In addition, the databases may, in a known manner, be stored locally or remotely from a device that accesses data in such a database. Furthermore, while unified databases may be contemplated, it is also possible that the databases may be distributed and/or duplicated amongst a variety of devices.

As used herein a "network" is an environment wherein one or more computing devices may communicate with one another. Such devices may communicate directly or indirectly, via a wired or wireless medium such as the Internet, LAN, WAN or Ethernet (or IEEE 802.3), Token Ring, or via any appropriate communications means or combination of communications means. Exemplary protocols include but are not limited to: Bluetooth™, Time Division Multiple Access (TDMA), Code Division Multiple Access (CDMA), Global System for Mobile communications (GSM), Enhanced Data rates for GSM Evolution (EDGE), General Packet Radio Service (GPRS), Wideband CDMA (WCDMA), Advanced Mobile Phone System (AMPS), Digital AMPS (D-AMPS), IEEE 802.11 (WI-FI), IEEE 802.3, SAP, the best of breed (BOB), system to system (S2S), or the like. Note that if video signals or large files are being sent over the network, a broadband network may be used to alleviate delays associated with the transfer of such large files, however, such is not strictly required. Each of the devices is adapted to communicate on such a communication means. Any number and type of machines may be in communication via the network. Where the network is the Internet, communications over the Internet may be through a website maintained by a computer on a remote server or over an online data network including commercial online service providers, bulletin board systems, and the like. In yet other embodiments, the devices may communicate with one another over RF, cable TV, satellite links, and the like. Where appropriate encryption or other security measures such as logins and passwords may be provided to protect proprietary or confidential information.

Communication among computers and devices may be encrypted to insure privacy and prevent fraud in any of a variety of ways well known in the art. Appropriate cryptographic protocols for bolstering system security are described in Schneier, APPLIED CRYPTOGRAPHY, PROTOCOLS, ALGORITHMS, AND SOURCE CODE IN C, John Wiley & Sons, Inc. 2d ed., 1996, which is incorporated by reference in its entirety.

The term "whereby" is used herein only to precede a clause or other set of words that express only the intended result, objective or consequence of something that is previously and explicitly recited. Thus, when the term "whereby" is used in a claim, the clause or other words that the term "whereby" modifies do not establish specific further limitations of the claim or otherwise restricts the meaning or scope of the claim.

It will be readily apparent that the various methods and algorithms described herein may be implemented by, e.g., appropriately programmed general purpose computers and computing devices. Typically a processor (e.g., one or more microprocessors) will receive instructions from a memory or like device, and execute those instructions, thereby performing one or more processes defined by those instructions. Further, programs that implement such methods and algorithms may be stored and transmitted using a variety of media (e.g., computer readable media) in a number of manners. In some embodiments, hard-wired circuitry or custom hardware may be used in place of, or in combination with, software instructions for implementation of the processes of various embodiments. Thus, embodiments are not limited to any specific combination of hardware and software. Accordingly, a description of a process likewise describes at least one apparatus for performing the process, and likewise describes at least one computer-readable medium and/or memory for performing the process. The apparatus that performs the process can include components and devices (e.g., a processor, input and output devices) appropriate to perform the process. A computer-readable medium can store program elements appropriate to perform the method.

What is claimed is:

1. A gaming system for facilitating an online game, comprising:

a game server cluster operable to communicate with a plurality of player gaming devices through a load balancer;

a cloud-based cache cluster operable to store real-time game state data for a plurality of online games and further operable to communicate with the game server cluster;

the game server cluster being operable to serve a plurality of distinct game instances for each of a plurality of different online games to any of the plurality of player devices by serving game outcomes to the plurality of player gaming devices by determining such outcomes using data received from a random number generator, wherein at least one game server of the game server cluster comprises:

a processor;

a memory storing a program for directing the processor, the program operable with the memory to:

provide an online game interface which includes a plurality of card positions into which cards are placed for a particular player, the card positions being configured in a triangle configuration, wherein the plurality of card positions include at least one subset of card positions within the triangle configuration, each of the at least one subset arranged in a respective sub-triangle located within the triangle configuration into which the plurality of card positions are arranged, further wherein (i) cards placed into card positions comprising the triangle configuration correspond to a first combination of cards that define a main player hand for a game event, and (ii) cards placed into card positions comprising the at least one subset arranged in the sub-triangle correspond to a second combination of cards; and (iii) both the first combination of cards and the second combination of cards is evaluated during game play to determine whether it comprises a winning combination of cards;

receive, electronically over a network, the data from the random number generator;

determine a result for a round of the online game;

dynamically select, based on the result, a plurality of cards to be dealt for the round;

output the selected cards in the online game interface by placing a single card of the plurality of dealt cards into each card position;

receive from the particular player an indication of at least one wager for the game event;

evaluate the plurality of dealt cards to determine whether (i) the first combination of cards comprises a first winning combination of cards; and (ii) the second combination of cards comprises a second winning combination of cards;

if it is identified that the plurality of dealt cards includes at least one of the first winning combination of cards or the second winning combination of cards, modify data in the online game interface in order to output to the particular player an indication that the plurality of dealt cards includes at least one of the first winning combination of cards and the second winning combination of cards; and cause at least one of a first prize corresponding to the first winning combination of cards and a second prize corresponding to the second winning combination of cards to be provided to the player.

2. The gaming system of claim 1, wherein the plurality of dealt cards consists of a first number of cards and the second combination of cards consists of a second number of cards which is less than the first number of cards and further wherein the first prize is determined based on the first number and the second prize is determined based on the second number.

3. The gaming system of claim 1, wherein the second winning combination of cards comprises three cards and further wherein the sum of values of two cards of the three cards equals a value of a third card of the three cards.

4. The gaming system of claim 1, wherein the processor is further operable with the program to:

output to the player an opportunity to replace at least one card of the plurality of dealt cards.

5. The gaming system of claim 4, wherein the processor is further operable with the program to:

receive from the particular player a selection of at least one card of the dealt cards to be replaced with a respective different card, thereby identifying at least one discarded card; and replace each of the at least one discarded card with a respective replacement card.

6. The gaming system of claim 4, wherein the processor is further operable with the program to:

reveal to the particular player a value of at least one card of the plurality of dealt cards prior to determining a final result for the game event; and wherein the opportunity to replace the at least one card is output after the value of the at least one card is revealed.

7. The gaming system of claim 1, wherein receiving the indication of the at least one wager comprises receiving a first wager corresponding to the first combination of cards and a second wager corresponding to the second combination of cards.

8. The gaming system of claim 1, wherein at least one of the plurality of cards is placed such that it's value is not initially indicated to the particular player.

9. The gaming system of claim 1, wherein the processor is further operable with the program to:

award a bonus prize to the particular player when both the first combination of cards includes the first winning combination and the second combination of cards includes the second winning combination.

10. The gaming system of claim 1, wherein the processor is further operable with the program to:

determine a value of each card of the plurality of dealt cards placed into a respective card position of the first combination of cards; and determine that the first combination of cards includes the first winning combination of cards by considering a first position of first combination of cards relative to a second position of the first combination of cards of at least one other card of the first combination of cards.

11. The gaming system of claim 1, wherein at least one card of the of the first combination of cards is placed such that it is in a card position included within at least two subsets of the at least one subset of card positions.

12. A non-transitory computer-readable medium storing instructions for directing a processor of a gaming server to perform a method for facilitating an online game, wherein the gaming server is a component of a gaming system that comprises a game server cluster operable to communicate with a plurality of player gaming devices through a load balancer, the game server cluster including the gaming server;

a cloud-based cache cluster operable to store real-time game state data for a plurality of online games and further operable to communicate with the game server cluster;

the game server cluster being operable to serve a plurality of distinct game instances for each of a plurality of different online games to any of the plurality of player devices by serving game outcomes to the plurality of player gaming devices by determining such outcomes using data received from a random number generator, and wherein the method the gaming server of the game server cluster performs comprises:

providing an online game interface which includes a plurality of card positions into which cards are placed for a particular player, the card positions being configured in a triangle configuration, wherein the plurality of card positions include at least one subset of card positions within the triangle configuration, each of the at least one subset arranged in a respective sub-triangle located within the triangle configuration into which the plurality of card positions are arranged, further wherein (i) cards placed into card positions comprising the triangle configuration correspond to a first combination of cards that define a main player hand for a game event, and (ii) cards placed into card positions comprising the at least one subset arranged in the sub-triangle correspond to a second combination of cards; and (iii) both the first combination of cards and the second combination of cards is evaluated during game play to determine whether it comprises a winning combination of cards;

receiving, electronically over a network, the data from the random number generator;

determining a result for a round of the online game;

dynamically selecting, based on the result, a plurality of cards to be dealt for the round;

outputting the selected cards in the online game interface by placing a single card of the plurality of dealt cards into each card position;

receiving from the particular player an indication of at least one wager for the game event;

evaluating the plurality of dealt cards to determine whether (i) the first combination of cards comprises a first winning combination of cards; and (ii) the second combination of cards comprises a second winning combination of cards;

if it is identified that the plurality of dealt cards includes at least one of the first winning combination of cards or the second winning combination of cards, modifying data in the online game interface in order to output to the particular player an indication that the plurality of dealt cards includes at least one of the first winning combination of cards and the second winning combination of cards; and causing at least one of a first prize corresponding to the first winning combination of cards and a second prize corresponding to the second winning combination of cards to be provided to the player.

13. A gaming system for facilitating an online game, comprising:

a game server cluster operable to communicate with a plurality of player gaming devices through a load balancer;

a cloud-based cache cluster operable to store real-time game state data for a plurality of online games and further operable to communicate with the game server cluster;

the game server cluster being operable to serve a plurality of distinct game instances for each of a plurality of different online games to any of the plurality of player devices by serving game outcomes to the plurality of player gaming devices by determining such outcomes using data received from a random number generator, wherein at least one game server of the game server cluster comprises:

a processor; and a memory storing a program, the processor being operable with the program to:

provide an online game interface which includes a plurality of card positions into which cards are placed, the card positions being arranged in an area of a first geometric shape, wherein the plurality of card positions include at least one subset of card positions arranged in a respective sub-area of the area, each such sub-area forming a respective second geometric shape within the first geometric shape, further wherein (i) cards placed into card positions comprising the first geometric shape correspond to a first combination of cards that define a main player hand for a game event, and (ii) cards placed into card positions comprising the at least one subset of card positions arranged in the sub-area forming the second geometric shape correspond to a second combination of cards; and (iii) both the first combination of cards and the second combination of cards is evaluated during game play to determine whether it comprises a winning combination of cards;

receive, electronically over a network, the data from the random number generator;

determine a result for a game event of the online game based on the data;

selecting, based on the result, a plurality of dealt cards for the game event, wherein each card of the plurality of dealt cards has a respective value;

place a single card of the plurality of dealt cards into each card position;

receive from a particular player an indication of at least one wager for the game event;

evaluate the plurality of dealt cards to determine whether (i) the first combination of cards comprises a first winning combination of cards; and (ii) the second combination of cards comprises a second winning combination of cards;

if it is identified that the plurality of dealt cards includes at least one of the first winning combination of cards or the second winning combination of cards, determine that the player qualifies for a first prize; and cause the first prize to be provided to the particular player who placed at least one wager on the game event.

14. The gaming system of claim 13, wherein the processor is further operable with the program to:

determine that cards placed into card positions comprising the second combination of cards qualify for a second prize because a value of at least one first card of the second combination of cards, which at least one first card is positioned in a first positional relationship relative to at least one second card of the second combination of cards, satisfies a mathematical relationship with respect to a value of the at least one second card of the second combination of cards; and cause the second prize to be provided to the particular player.

15. The gaming system of claim 13, wherein determining that the first combination of cards qualifies for a first prize comprises determining that a first value of at least one first card of the first combination of cards, which at least one first card is positioned in a first predetermined positional relationship relative to at least one second card of the first combination of cards, satisfies a mathematical relationship with respect to a value of the at least one second card.

16. The gaming system of claim 13, wherein the first geometric shape is a triangle.

17. The gaming system of claim 16, wherein the second geometric shape is a smaller triangle located within a larger triangle which comprises the first geometric shape.

18. The gaming system of claim 13, wherein at least one card of the first combination of cards is placed such that it is in a card position included within the second combination of cards.

* * * * *